US011219805B2

(12) United States Patent
Larsen et al.

(10) Patent No.: US 11,219,805 B2
(45) Date of Patent: Jan. 11, 2022

(54) MULTI-MATERIAL GOLF CLUB HEAD

(71) Applicant: Acushnet Company, Fairhaven, MA (US)

(72) Inventors: Peter Larsen, Carlsbad, CA (US); Peter L. Soracco, Carlsbad, CA (US); David S. Cornelius, Carlsbad, CA (US); Ryuichi Sugimae, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 4 days.

(21) Appl. No.: 16/528,210

(22) Filed: Jul. 31, 2019

(65) Prior Publication Data

US 2020/0023247 A1 Jan. 23, 2020

Related U.S. Application Data

(63) Continuation-in-part of application No. 16/042,979, filed on Jul. 23, 2018, now Pat. No. 10,653,927.

(51) Int. Cl.
*A63B 53/04* (2015.01)

(52) U.S. Cl.
CPC ..... *A63B 53/0466* (2013.01); *A63B 53/0429* (2020.08); *A63B 53/0437* (2020.08); *A63B 53/0454* (2020.08)

(58) Field of Classification Search
CPC ..... A63B 53/0466; A63B 53/0429; A63B 53/0437; A63B 53/0454
USPC ..... 473/324–350, 287–292
See application file for complete search history.

(56) References Cited

U.S. PATENT DOCUMENTS

| | | | | |
|---|---|---|---|---|
| 1,485,685 | A | 3/1924 | McMahon | |
| 1,562,956 | A | 11/1925 | Guerne | |
| 3,387,844 | A | 6/1968 | Shippee | |
| 3,556,532 | A | 1/1971 | Ballmer | |
| 4,149,726 | A | 4/1979 | Tredway, Sr. | |
| 4,604,319 | A * | 8/1986 | Evans | B29C 70/086 428/113 |
| 5,064,197 | A | 11/1991 | Eddy | |
| 5,106,094 | A | 4/1992 | Desbiolles | |
| 5,346,216 | A | 9/1994 | Aizawa | |
| 5,362,055 | A | 11/1994 | Rennie | |
| 5,431,396 | A | 7/1995 | Shieh | |
| 5,467,983 | A | 11/1995 | Chen | |

(Continued)

OTHER PUBLICATIONS

Itoh, Masayasu et al., "Effects of Crystallization on Cell Morphology in Microcellular Polyphenylene Sulfide", Furukawa Rev., 2005, vol. 28, pp. 32-38.

*Primary Examiner* — Sebastiano Passaniti

(57) ABSTRACT

Golf clubs heads having a forward portion located at a front side of the golf club head and an aft portion located rearward of the forward portion and joined to the forward portion. The front portion includes a forward joint section and the aft portion includes an aft joint section. The aft portion also includes an aft rib attached to an interior surface of the aft portion, the aft rib extends, from an interior surface of the aft joint section, in a direction away from the striking face. The golf club head may also include a crown the crown having an areal density of less than 1000 g/m$^2$ and made from a structure comprising an inner layer, a middle layer in contact with the inner layer, and an outer layer in contact with the middle layer.

22 Claims, 31 Drawing Sheets

(56) References Cited

U.S. PATENT DOCUMENTS 5,499,814 A 3/1996 Lu
5,718,641 A 2/1998 Lin
RE35,955 E 11/1998 Lu
5,997,415 A * 12/1999 Wood ..... A63B 53/0466 473/346
6,165,081 A 12/2000 Chou
6,299,547 B1 10/2001 Kosmatka
6,383,090 B1 5/2002 O'Doherty
6,602,149 B1 8/2003 Jacobson
6,612,938 B2 9/2003 Murphy
6,695,715 B1 2/2004 Chikaraishi
6,852,038 B2 2/2005 Yabu
6,878,073 B2 4/2005 Takeda
7,056,228 B2 6/2006 Beach
7,108,614 B2 * 9/2006 Lo ..... A63B 53/0466 473/345
7,166,038 B2 1/2007 Williams
7,413,520 B1 8/2008 Hocknell
7,510,485 B2 * 3/2009 Yamamoto ..... A63B 53/0466 473/345
7,607,992 B2 * 10/2009 Nishio ..... A63B 53/0466 473/342
8,007,369 B2 * 8/2011 Soracco ..... A63B 53/04 473/332
8,187,116 B2 5/2012 Boyd
8,540,590 B2 * 9/2013 Tsukada ..... A63B 53/0466 473/345
8,602,912 B2 12/2013 Stites
8,651,975 B2 2/2014 Soracco
8,777,778 B2 * 7/2014 Solheim ..... A63B 53/0466 473/346
8,849,635 B2 9/2014 Hayase
9,138,619 B2 * 9/2015 Takechi ..... A63B 60/52
9,403,295 B2 8/2016 Sander
9,517,394 B1 12/2016 Dacey
9,694,254 B2 * 7/2017 Ashino ..... A63B 53/04
9,821,201 B1 * 11/2017 Parsons ..... A63B 53/0466
10,065,084 B2 * 9/2018 Myrhum ..... A63B 60/52
10,195,498 B2 * 2/2019 Solheim ..... A63B 53/08
10,232,230 B2 * 3/2019 Takehara ..... A63B 53/0466
10,245,479 B2 4/2019 Murphy
10,343,030 B2 * 7/2019 Funaki ..... A63B 60/52
10,434,380 B2 * 10/2019 Kawaguchi ..... A63B 60/52
10,464,494 B2 * 11/2019 Chen ..... B60R 9/058
10,569,143 B2 * 2/2020 Funaki ..... A63B 53/0466
10,653,927 B2 5/2020 Murphy et al.
11,007,409 B2 * 5/2021 Kawaguchi ..... A63B 53/0466
2002/0019265 A1 2/2002 Allen
2004/0033844 A1 2/2004 Chen
2004/0204265 A1 10/2004 Chang
2005/0075192 A1 4/2005 Han
2005/0143189 A1 * 6/2005 Lai ..... A63B 60/52 473/335
2006/0134408 A1 * 6/2006 Kaneko ..... B32B 15/20 428/343
2006/0148589 A1 7/2006 Liou
2010/0029409 A1 2/2010 Noble
2010/0323812 A1 12/2010 Boyd
2013/0130584 A1 * 5/2013 Fujiwara ..... B32B 5/28 442/392
2015/0273289 A1 * 10/2015 Ashino ..... A63B 53/04 473/332
2015/0290503 A1 * 10/2015 Su ..... A63B 53/0466 473/324
2015/0360094 A1 12/2015 Deshmukh
2017/0136314 A1 * 5/2017 Myrhum ..... A63B 60/50
2020/0023246 A1 1/2020 Murphy et al.
2020/0023247 A1 1/2020 Larsen
2020/0023248 A1 1/2020 Murphy

* cited by examiner

| | Outer Layer | | | | | Middle Layer | | | | | Inner Layer | | | | | TOTALS | | | |
|---|---|---|---|---|---|---|---|---|---|---|---|---|---|---|---|---|---|---|---|
| | $\rho_1$ | $t_1$ | $AW_1$ | $A_1$ | $mass_1$ | $\rho_2$ | $t_2$ | $AW_2$ | $A_2$ | $mass_2$ | $\rho_3$ | $t_3$ | $AW_3$ | $A_3$ | $mass_3$ | $A_{TOT}$ | $mass_{TOT}$ | $t_{TOT}$ | $AW_{TOT}$ |
| Crown Design | (g/cm³) | (mm) | (g/m²) | (mm²) | (g) | (g/cm³) | (mm) | (g/m²) | (mm²) | (g) | (g/cm³) | (mm) | (g/m²) | (mm²) | (g) | (mm²) | (g) | (mm) | (g/m²) |
| Titanium Only | | | | | | | | | | | | | | | | TOTALS | | | |
| | 4.45 | 0.4 | 1780 | 9000 | 16.00 | | | | | | | | | | | 9000 | 16.02 | 0.40 | 1780 |
| Composite Only | | | | | | | | | | | | | | | | TOTALS | | | |
| | 1.60 | 0.6 | 960 | 9000 | 8.60 | | | | | | | | | | | 9000 | 8.64 | 0.60 | 960 |
| Example 1 | | | | | | | | | | | | | | | | TOTALS | | | |
| | 1.91 | 0.2 | 382 | 9000 | 3.40 | 0.10 | 2.90 | 290 | 9000 | 2.60 | 1.91 | 0.1 | 191 | 9000 | 1.70 | 9000 | 7.77 | 3.20 | 863 |
| Example 2 | | | | | | | | | | | | | | | | TOTALS | | | |
| | 1.60 | 0.25 | 400 | 9000 | 3.60 | 1.0 | 1.50 | 240 | 9000 | 2.20 | 1.60 | 0.25 | 200 | 9000 | 1.80 | 9000 | 7.56 | 2.0 | 840 |
| Example 3 | | | | | | | | | | | | | | | | TOTALS | | | |
| | 1.60 | 0.25 | 400 | 9000 | 3.60 | 0.35 | 1.00 | 350 | 9000 | 3.20 | 1.60 | 0.25 | 200 | 9000 | 1.80 | 9000 | 8.55 | 1.50 | 950 |

FIG. 28

| Example Crown Number | Mass | Mass increase vs Baseline | Deflection | Deflection vs Baseline | D Score |
|---|---|---|---|---|---|
| Baseline | 5.21 | 0.00% | 3.96 | 100.00% | 1.00 |
| 1 | 11.38 | 118.43% | 2 | 50.51% | 0.31 |
| 2 | 5.21 | 0.00% | 2.64 | 66.67% | 1.33 |
| 3 | 5.21 | 0% | 1.38 | 34.85% | 1.65 |
| 4 | 2.22 | -57% | 9.5 | 239.90% | 0.17 |
| 5 | 4.45 | -15% | 6.4 | 161.62% | 0.53 |
| 6 | 3.71 | -29% | 8.79 | 221.97% | 0.07 |
| 7 | 4.29 | -18% | 2.11 | 53.28% | 1.64 |
| 8 | 6.91 | 33% | 1.27 | 32.07% | 1.35 |
| 9 | 4.55 | -13% | 2 | 50.51% | 1.62 |
| 10 | 4.57 | -12% | 2.57 | 64.90% | 1.47 |
| 11 | 4.63 | -11% | 6.18 | 156.06% | 0.55 |

FIG. 29

MULTI-MATERIAL GOLF CLUB HEAD

RELATED APPLICATIONS

The present application is a continuation-in-part of U.S. patent application Ser. No. 16/042,979, titled Multi-Material Golf Club Head, filed on Jul. 23, 2018, which is incorporated herein in its entirety. To the extent appropriate, priority is claimed to the above application.

FIELD OF THE INVENTION

The present invention relates generally to a new and improved golf club having a secondary barrier behind a striking face portion via a panel member. The panel member allows the golf club head to incorporate exotic materials at the rear aft portion of the golf club head without sacrificing performance. More specifically the secondary barrier preserves the acoustic characteristics of a metallic golf club head while allowing the rear aft portion of the golf club head to be made out of exotic materials that may generally degrade the acoustic characteristics of a golf club head.

BACKGROUND OF THE INVENTION

The utilization of lightweight materials in a golf club head is generally known. The utilization of lightweight materials in a golf club head removes mass from specific portions of the golf club head and allows it to be redistributed to more optimized areas. U.S. Pat. No. 6,612,938 to Murphy et al. illustrates one of the earlier attempts to use exotic materials in a golf club head such as plies of pre-preg material.

However, despite the potential gains in the discretionary mass gained by the utilization of such lightweight material, the utilization of such material usually comes with some drawbacks. More specifically, the utilization of such lightweight material may generally come with an undesirable acoustic characteristic, making the golf club undesirable to a golfer irrespective of performance.

U.S. Pat. No. 5,064,197 to Eddy back in 1991 provides one of the earlier attempts to adjust the acoustic characteristics of a golf club by providing a first forward chamber in the head opening to the club head face, wherein the forward chamber vibrates at a given primary frequency.

U.S. Pat. No. 8,651,975 to Soracco provided another example of an attempt to address the acoustic characteristics associated with golf clubs that utilizes exotic material. More specifically, Soracco provided a golf club head with sound tuning composite members forming at least a portion of the surface of the golf club head.

Finally, U.S. Pat. No. 8,849,635 to Hayase et al. went above and beyond the mere basic design of a golf club head for acoustic characteristics and even made an attempt to predict modal damping ratio of composite golf club heads.

Despite the above, none of the references provide a method to improve the performance of a golf club head by providing a way to improve the performance of a golf club head utilizing advanced materials all while providing a clean way to address the degradation of the acoustic characteristics of the golf club head. Hence, it can be seen from the above that a golf club design that is capable of achieving both of the goal of incorporating exotic lightweight materials in order to increase discretionary mass as well as achieving a desirable acoustic characteristic while minimizing the undesirable sound and feel of the golf club head.

BRIEF SUMMARY OF THE INVENTION

One aspect of the present invention is a golf club head comprising of a frontal acoustic chamber located at a front side of the golf club head and made out of a first material having a first volume, and a rear weight saving chamber located rearward of the frontal acoustic chamber at least partially made out of a second material having a second volume, wherein the frontal acoustic chamber and the rear weight saving chamber are separated by a panel member that bifurcates the golf club head by connecting to a crown portion and a sole portion, and wherein said second material has a lower density than said first material, and wherein the golf club head has a Front to Rear Volume Ratio of less than about 0.35, the Front to Rear Volume Ratio defined as the first volume of the frontal acoustic chamber divided by a second volume of the rear weight saving chamber.

In another aspect of the present invention is a golf club head comprising of a frontal acoustic chamber located at a front side of the golf club head and made out of a first material having a first volume, and a rear weight saving chamber located rearward of the frontal acoustic chamber at least partially made out of a second material having a second volume, wherein the frontal acoustic chamber and the rear weight saving chamber are separated by a panel member that bifurcates the golf club head by connecting to a crown portion and a sole portion, and wherein said second material has a lower density than said first material, and wherein the panel member is further comprised of an upper sub-panel member, a middle sub-panel member, and a lower sub-panel member, and all three panel members are all placed at different angles relative to a striking face.

In another aspect of the present invention is a golf club head comprising of a frontal acoustic chamber located at a front side of the golf club head and made out of a first material having a first volume, and a rear weight saving chamber located rearward of the frontal acoustic chamber at least partially made out of a second material having a second volume, wherein the frontal acoustic chamber and the rear weight saving chamber are separated by a panel member that bifurcates the golf club head by connecting to a crown portion and a sole portion, and wherein said second material has a lower density than said first material, wherein the panel member is curved away from the front side of the golf club head such that a center of the panel member is placed further away from a striking face than at a crown and a sole portion of the panel member.

In one aspect, the technology relates to a golf club head that includes a forward portion located at a front side of the golf club head and comprising a first material. The forward portion includes a striking face and a forward joint section having an exterior surface and an interior surface. The golf head also includes an aft portion located rearward of the forward portion and joined to the forward portion, the aft portion comprising a second material. The aft portion includes an aft joint section joined with the forward joint section, the aft joint section having an interior surface and an exterior surface, wherein the exterior surface of the aft joint section is in contact with the interior surface of the forward joint section; and an aft rib attached to an interior surface of the aft portion, the aft rib extending, from an interior surface of the aft joint section, in a direction away from the striking face.

In an example, the aft rib is a continuous aft rib extending from a first location on a first half of the interior surface of the aft joint section to a second location on a second half of the interior surface of the aft joint section. In another example at least one surface of the continuous aft rib is entirely in contact with the interior surface of the aft portion. In yet another example, the aft joint section and the forward joint section are joined together as a taper joint. In still another example, the aft rib and the aft portion are configured such that the exterior surface of the aft joint section exerts a force on the interior surface of the forward joint section when the golf club head strikes a golf ball. In an additional example, the aft joint section and the forward joint section are joined together via an adhesive. In still yet another example, the aft portion includes an opening towards the forward portion, and the aft joint section extends continuously around a circumference of the opening.

In another example, the first material is a metallic material and the second material is a composite material. In an additional example, the aft rib is made from a third material, the third material having a Young's Modulus value greater than a Young's Modulus value for the second material. In yet another example, at least a segment of the aft portion is made from a structure comprising: an inner layer; a middle layer in contact with the inner layer; and an outer layer in contact with the middle layer, wherein a distance between an interior surface of the inner layer and an exterior surface of the outer layer is at least 0.8 mm. In still another example, the structure has an areal density of less than 1000 g/m$^2$.

In another aspect, the technology relates to a golf club head that includes a striking face, a sole, and a crown. The crown has an areal density of less than 1000 g/m$^2$ and is made from a structure comprising: an inner layer; a middle layer in contact with the inner layer; and an outer layer in contact with the middle layer, wherein a distance between an interior surface of the inner layer and an exterior surface of the outer layer is at least 0.8 mm.

In an example, the distance between the interior surface of the inner layer and the exterior surface of the outer layer is at least 2.5 mm. In another example, the inner layer has a thickness of less than about 0.2 mm; and the middle layer has a thickness of at least 0.6 mm. In yet another example, the crown has an areal density of less than 900 g/m$^2$. In still another example, the outer layer has an areal density of less than about 400 g/m$^2$; the middle layer has an areal density of less than about 300 g/m$^2$; and the inner layer has an areal density of less than about 200 g/m$^2$. In still yet another example, the inner layer and the outer layer comprise a carbon-fiber material; and the middle layer comprises a foamed material. In an additional example, the inner layer and the outer layer comprise a thermoplastic composite material. In another example, the crown is part of an aft portion joined to a forward portion, wherein the aft portion includes an aft joint section and the golf club head further comprises an aft rib attached to an interior surface of the aft joint section and an interior surface of the inner layer of the crown, the aft rib extending in a direction away from the striking face.

In another aspect, the technology relates to a golf club head that includes a forward portion located at a front portion of the golf club head and made from at least a first material. The forward portion includes a striking face and a forward joint section having an exterior surface and an interior surface. The golf club head also includes an aft portion located rearward of the forward portion and joined to the forward portion, the aft portion made from at least a second material. The aft portion includes an aft joint section joined with the forward joint section, the aft joint section having an interior surface and an exterior surface, wherein the exterior surface of the aft joint section is in contact with the interior surface of the forward joint section; and a crown section having an areal density of less than 2000 g/m$^2$. The crown is made from a structure including an inner layer; a middle layer in contact with the inner layer; and an outer layer in contact with the middle layer, wherein a distance between an interior surface of the inner layer and an exterior surface of the outer layer is at least 0.8 mm. The aft portion also includes an aft rib attached to an interior surface of the aft joint section, the aft rib extending in a direction away from the striking face.

In another aspect, the technology relates to a golf club head that includes a striking face, a sole, and a crown, the crown having an areal density of less than 1000 g/m$^2$. The crown is made from a structure comprising: an inner layer; a middle layer in contact with the inner layer; and an outer layer in contact with the middle layer, wherein an amount of deflection of the crown as a function of a mass of the crown is governed by the following equation when subjected to a pressure of 20 MPa on or near the geometric center: Deflection$\leq$−0.3177 (Mass)+5.615.

In an example, the distance between an interior surface of the inner layer and an exterior surface of the outer layer is at least 0.8 mm. In another example, the distance between the interior surface of the inner layer and the exterior surface of the outer layer is at least 2.5 mm. In still another example, the crown has a D Score of at least 1.3. In yet another example, the middle layer comprises a foamed material.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

FIG. 28 of the accompanying drawings shows a table of data representing characteristics of example crowns in accordance with embodiments of the present invention;

FIG. 29 of the accompanying drawings shows a table representing characteristics of example crowns in accordance with embodiments of the present invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
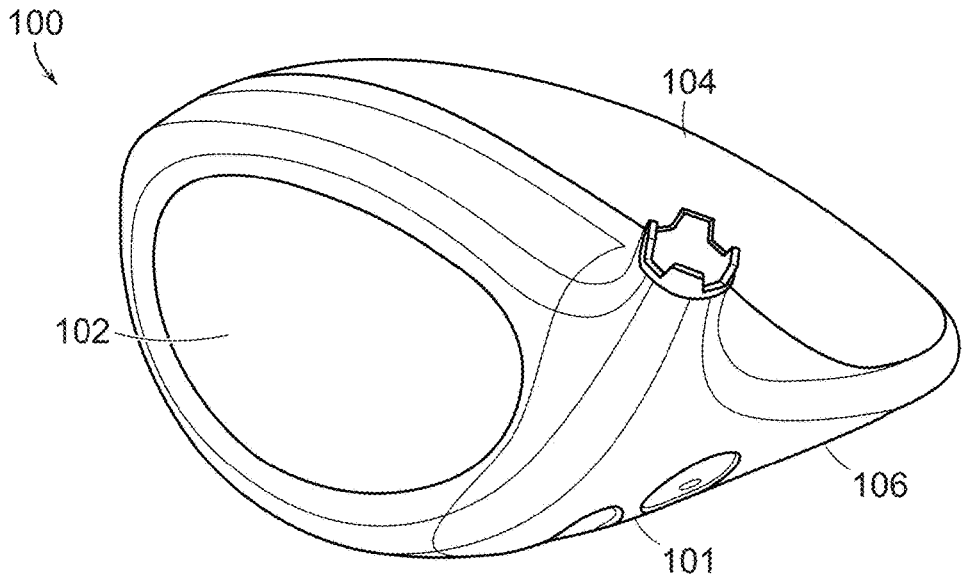
FIG. 1 of the accompanying drawings shows a frontal perspective view of a golf club head in accordance with the present invention.

FIG. 1 of the accompanying drawings shows a perspective view of a golf club head 100 in accordance with an exemplary embodiment of the present invention. The golf club head 100 shown in FIG. 1 provides only a rough sketch of the externals components of the golf club head 100 without illustrating the internal workings of the golf club head 100. More specifically, golf club head 100 will generally have a striking face 102 placed at a frontal portion of a chassis 101 the golf club head 100, a sole portion 106 located at the bottom of an aft portion of the chassis 101, and a crown portion 104 located at the top of an aft portion of the chassis 101. The striking face 102, together with the chassis 101, which includes the frontal portion and the skirt portion, may generally be made out of a first material having a density of between about 4.0 g/cc and about 4.7 g/cc, more preferably between about 4.1 g/cc and about 4.6 g/cc, and most preferably about 4.4 g/cc. The first material in most cases may generally be a titanium metallic material such Titanium 8-1-1, ATI 425 Titanium, SP 700 Titanium, KS 120 Titanium, KS 100 Titanium, Ti 6-4, or any other type of titanium material having the density recited above without departing from the scope and content of the present invention. However, in alternative embodiments of the present invention, the first material may be steel in a fairway type of construction without departing from the scope and content of the present invention. The crown portion 104 and the sole portion 106 in accordance with this embodiment of the present invention may be made out of a second lightweight material having a lower density than the remainder of the golf club head in order to achieve the weight savings desired without departing from the scope and content of the present invention. The lightweight second material could be made out of aluminum type material with a density of between about 2.5 g/cc and about 2.9 g/cc, a magnesium material with a density of about 1.738 g/cc, a wooden material that may have a density as low as 0.6 g/cc, but most commonly a fiber reinforced plastic composite type material may be used having a density of between about 1.2 g/cc to about 1.8 g/cc. More information regarding composite materials with a low fiber areal mass in a golf club head may be found in U.S. Patent Publication 2015/0360094 to Deshmukh, the disclosure of which is incorporated by reference in its entirety. Although not visible from FIG. 1, the golf club head 100 in accordance with this embodiment of the present invention may be internally separated into a frontal acoustic chamber and a rear weight saving member, creating a dual chambered golf club head 100 that is capable of achieving improved performance characteristics by increasing the discretionary weight of the golf club all while preserving the acoustic signature of the golf club head 100.

Figure 2:
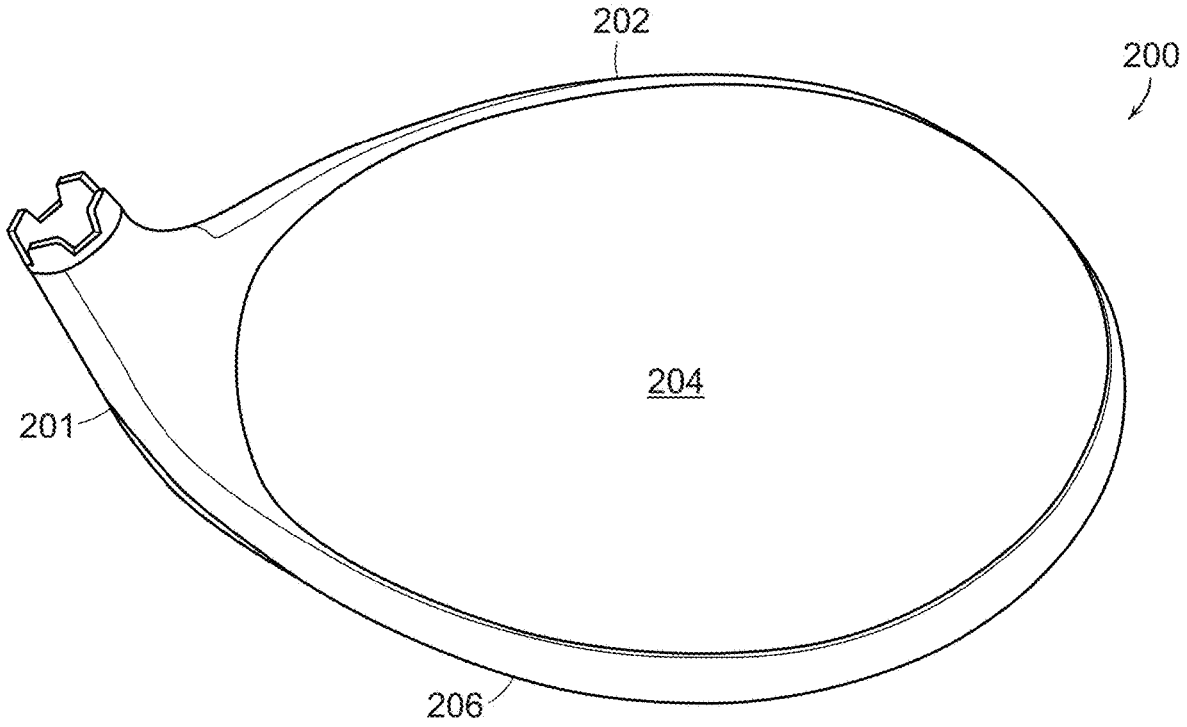
FIG. 2 of the accompanying drawings shows a rear perspective view of a golf club head in accordance with the present invention.

FIG. 2 of the accompanying drawings shows a rear perspective view of a golf club head 200 in accordance with an alternative embodiment of the present invention. Golf club head 200 may generally be comprised out of very similar components illustrated in FIG. 1, comprising of a metallic chassis 201, a striking face 202, a crown 204, and a sole 206. However, in this angle shown in FIG. 2, the internal components of the golf club head 200 can be shown more clearly if the crown 204 cover is removed for illustration purposes.

Figure 3:
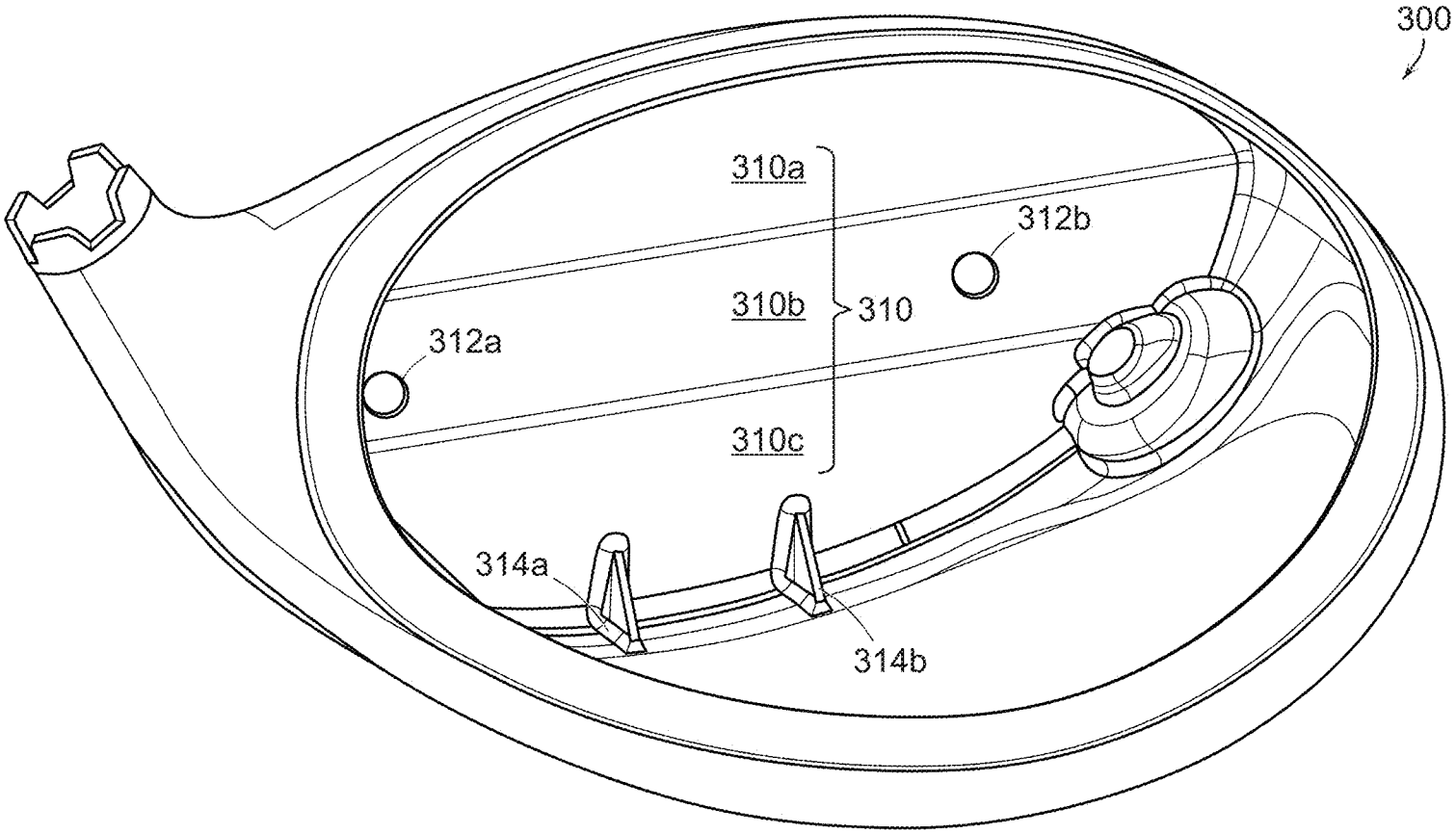
FIG. 3 of the accompanying drawings shows a partial rear perspective view of a golf club head in accordance with the present invention wherein the crown is removed to illustrate internal components.

FIG. 3 of the accompanying drawings shows a perspective view of a golf club head 300 in accordance with an alternative embodiment of the present invention wherein the crowns cover is removed. The removal of the crown cover allows the internal components of the golf club head 300 to be shown more clearly. More specifically, FIG. 3 of the accompanying drawings shows the rear weight saving chamber component of the golf club head 300. The rear weight saving chamber shown here is created by a panel member 310 that separates the frontal acoustic chamber from the rear weight saving chamber. The panel member 310 in accordance with this embodiment of the present invention may generally be multi-facetted. More specifically, the panel member 310 shown in FIG. 3 contains at least one facet or bend that separates the panel member 310 into different sub-components to further improve the acoustic signature of the golf club head 300. The faceting of the panel member 310 shown in FIG. 3 may create three different sub-panel members 310*a*, 310*b*, and 310*c*. The upper sub-panel member 310*a* may generally be connected to the crown portion of the golf club head 300; the middle sub-panel member 310*b* may generally be connected to the bottom of the upper sub-panel member 310*a*; and the bottom sub-panel member 310*c* may generally be connected to the bottom of the middle sub-panel member 310*b* and also connected to the sole portion of the golf club head 300.

In addition to illustrating the panel member 310, FIG. 3 of the accompanying drawing providing a cut open view of golf club head 300 also illustrates a plurality of circular pressure release holes 312*a* and 312*b* located in the middle sub-panel member 310*b* of the panel member 310. The plurality of two or more pressure release holes 312*a* and 312*b* allows pressure built up in the frontal acoustic chamber during impact with a golf ball to travel towards the rear weight saving chamber to minimize any undesirable acoustic effects whenever the design of the golf club head 300 necessitates their utilization. In this exemplary embodiment of the present invention, the plurality of pressure release holes 312*a* and 312*b* may have an opening area of between about 15 mm to about 25 mm, more preferably between about 17 mm and about 23 mm, and most preferably about 20 mm. It should be noted here that although the present embodiment shows a plurality of two pressure release holes 312*a* and 312*b*, the present invention can incorporate only one pressure release hole 312, or more than two pressure release hole 312 without departing from the scope and content of the present invention. Moreover, although the present embodiment of the present invention shows that the pressure release holes 312*a* and 312*b* are located in the middle sub-panel member 310*b*, they can be located at other portions of the panel member 310 to achieve similar goals without departing from the scope and content of the present invention. In fact, in alternative embodiments of the present invention, the golf club head 300 could be constructed without any pressure release holes 312*a* and 312*b* without departing from the scope and content of the present invention. (See FIG. 7)

Finally FIG. 3 of the accompanying drawings also shows a plurality of ribs 314*a* and 314*b*, that connect to the bottom sub-panel member 310*c* and the sole to provide structural rigidity to the panel member 310 to further tune the acoustic signature of the golf club head 300 without departing from the scope and content of the present invention. It should be noted that although FIG. 3 shows two ribs 314*a* and 314*b*, the present invention only incorporates the ribs 314*a* and 314*b* when the acoustic signature of the golf club head 300 needs further tuning. In fact, in alternative embodiments of the present invention, one rib, three ribs, or any multiple ribs may be used as necessary without departing from the scope and content of the present invention. In fact, in extreme situations, the current design may not incorporate any ribs at all. (See FIG. 6)

Figure 4:
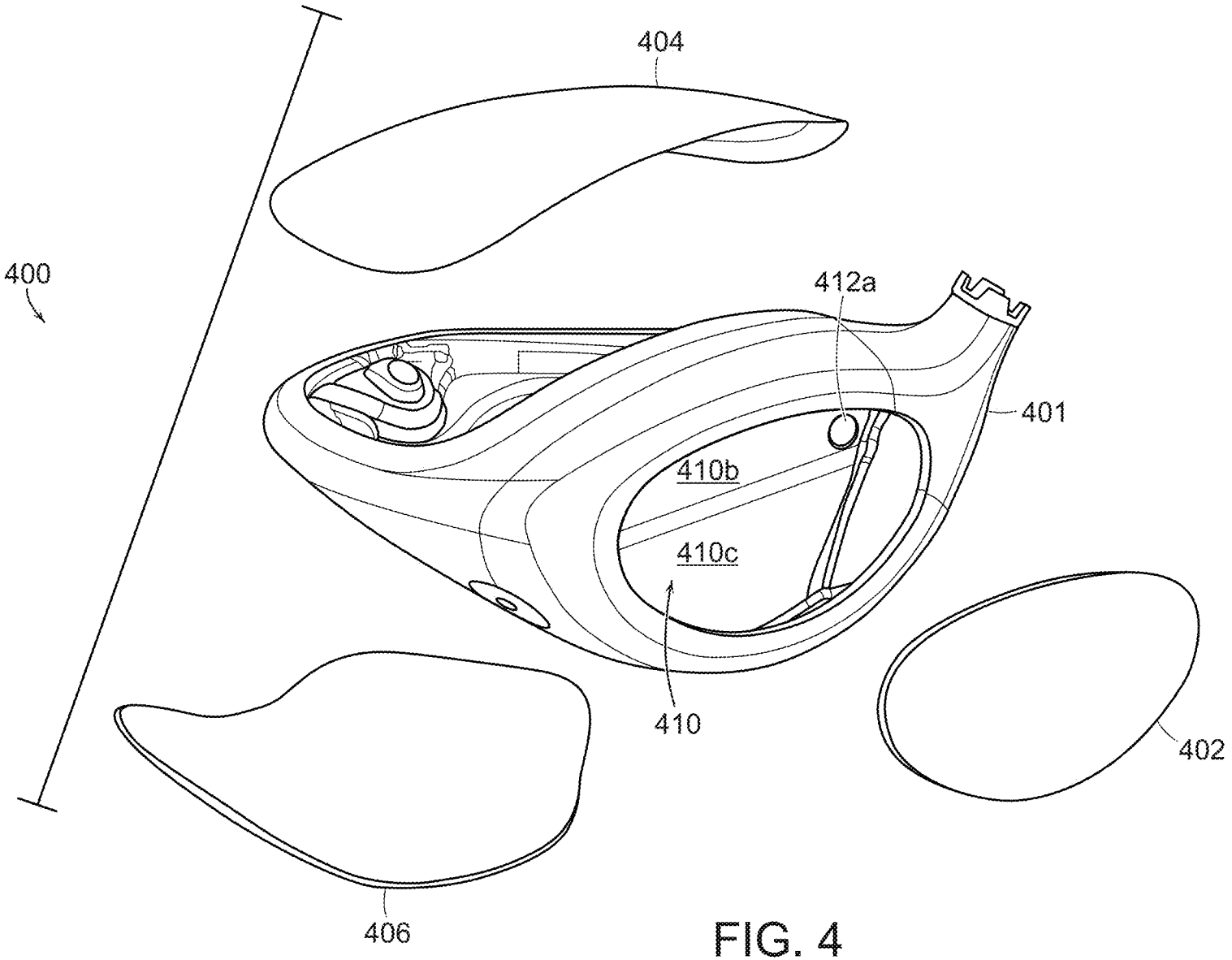
FIG. 4 of the accompanying drawings shows an exploded perspective view of a golf club head in accordance with the present invention.

FIG. 4 of the accompanying drawings shows an exploded view of a golf club head 400 in accordance with an embodiment of the present invention. The exploded view of the golf club head 400 shown here in FIG. 4 allows the relationship between the various components to be shown more clearly. More specifically, FIG. 4 introduces the ability of the sole 406 of the golf club head to be detachable from the chassis 401 of the golf club head 400. The sole 406 works in conjunction with the crown 404 to create the rear weight saving chamber previously discussed, which once again, is separated from the frontal acoustic chamber via a panel member 410. This exploded frontal view with the striking face 402 removed, allows the frontal acoustic chamber to be shown more clearly, and the frontal view of the panel member 410 to be shown as well. Similar to the discussion above, the panel member 410 may be further divided into an upper sub-panel member (not shown in FIG. 4), a middle sub-panel member 410*b*, and a lower sub-panel member 410*c*, all while incorporating the same pressure release hole 412*a* and 412*b* (not shown in FIG. 4).

Figure 5:
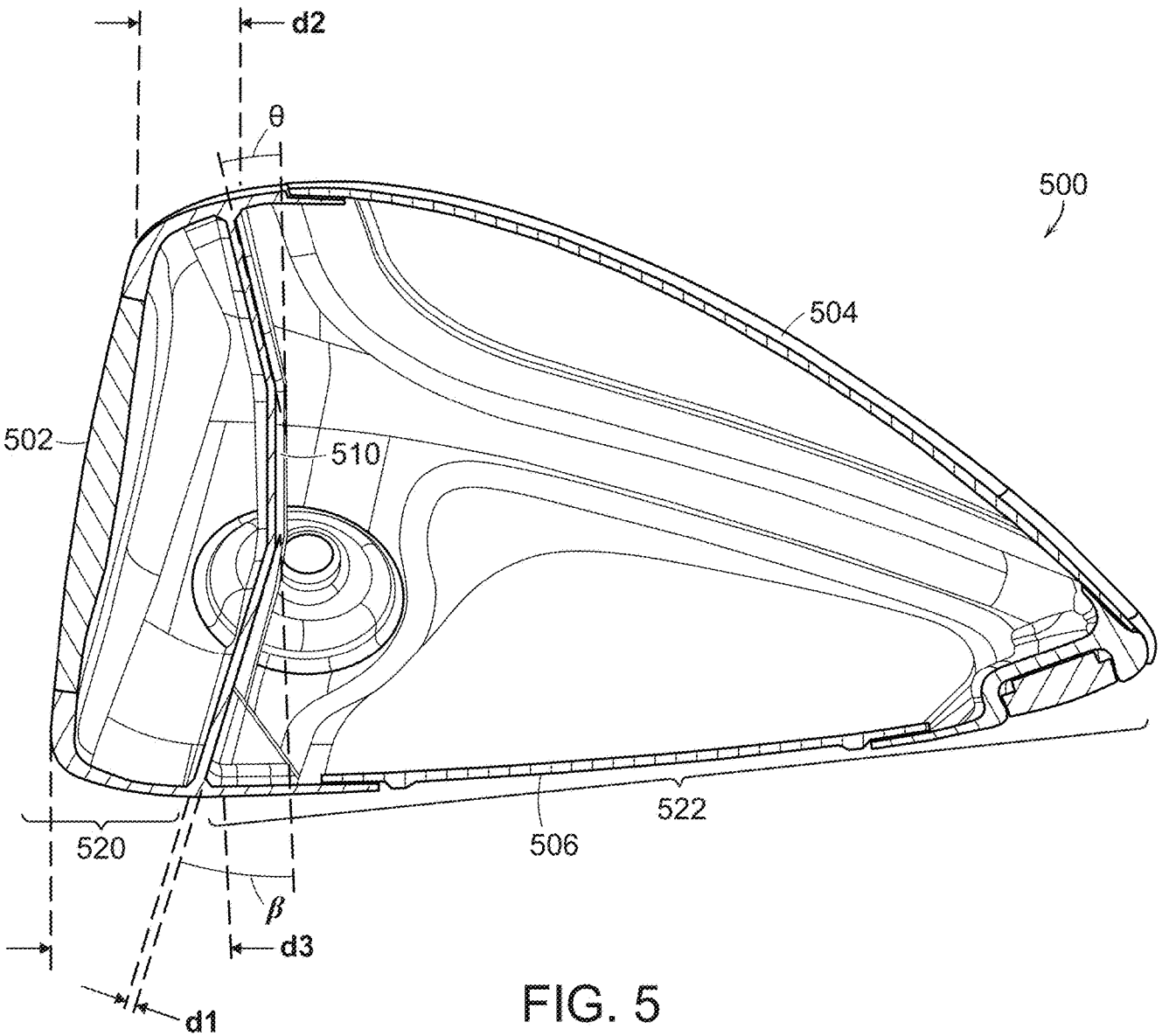
FIG. 5 of the accompanying drawings shows a cross-sectional view of a golf club head in accordance with the present invention.

In order for the relationship between the frontal acoustic chamber and the rear weight saving chamber to be shown more clearly, a cross-sectional view of the golf club head 400 may be more helpful. FIG. 5 of the accompanying drawings does exactly this by providing a cross-sectional view of a golf club head 500 in accordance with an exemplary embodiment of the present invention. Although previous discussion has hinted at the existence of a frontal acoustic chamber 520 and a rear weight saving chamber 522 within the internals of the golf club head 500, the cross sectional view of the golf club head 500 identifies the here as frontal acoustic chamber 520 and rear weight saving chamber 522, which are separated and bifurcates the golf club via a panel member 510. The frontal acoustic chamber 520 shown here is comprised out of a frontal portion of a chassis of the golf club head 500 as well as the striking face 502 insert. The rear weight saving chamber 522 may generally be comprised of at least one composite panel that helps achieve the weight saving goals of the golf club head 500. The word "composite" as used in this application may refer to the general term of any material that has two or more different materials combined together, however, in a preferred embodiment of the present invention, fiber reinforced plastic is the general material. In this specific embodiment shown in FIG. 5, the golf club head 500 incorporates two composite panels by incorporating a lightweight composite crown 504 and a lightweight composite sole 506 to maximize the weight savings; however, in alternative embodiments either one of the pieces may be used exclusively without the other component without departing from the scope and content of the present invention.

The cross-sectional view of the golf club head 500 shown in FIG. 5, in addition to showing the relationship between the frontal acoustic chamber 520 and the rear weight saving chamber 522, also provides a perspective on their relative volumes to one another to create a very critical volume ratio. First and foremost, this cross-sectional view, is taken along a plane that runs front and back through the golf club head, taken down the center through the center of the face. The golf club head 500 may generally have a Front to Rear Volume Ratio of less than about 0.50, more preferably less than about 0.40, and most preferably less than about 0.35; wherein the Front to Rear Volume Ratio is defined by Equation (1) below:

$$\text{Front to Rear Volume Ratio} = \frac{\text{Volume of Frontal Acoustic Chamber 520}}{\text{Volume of Rear Weight Saving Chamber 522}} \quad \text{Eq. (1)}$$

More specifically, the frontal acoustic chamber 520 may generally have a volume of less than about 230 cc, more preferably less than about 150 cc, and most preferably less than about 100 cc; while the rear weight saving chamber 522 may have a volume of greater than about 230 cc, more preferably greater than about 310 cc, and most preferably greater than about 360 cc.

In order to create the Front to Rear Volume Ratio identified above, the panel member 510 shown in this embodiment may generally have a thickness d1 of between about 0.1 mm to about 2.0 mm, more preferably between about 0.25 mm to about 1.0 mm, and most preferably about 0.5 mm. The thickness of the panel member 510 is important and critical to the proper functioning of the golf club head 500, as it creates the necessary barrier between the frontal acoustic chamber 520 and the rear weight saving chamber 522. If the thickness d1 of the panel member 510 is too thick, then the correlation between the vibration of the frontal acoustic chamber 520 and the rear weight saving chamber 522 might no longer be synchronized, eliminating the efficiency of the frontal acoustic chamber 520. Alternatively, if the thickness d1 is too thin, then the correlation between the two chambers might be too high, allowing the acoustic signature to be over damped by the composite material used by the rear weight saving chamber 522. It should be noted here that although the thickness d1 is shown here as constant throughout the panel member 510, the thickness could be variable depending on the needs of the golf club head 500 without departing from the scope and content of the present invention.

FIG. 5 of the accompanying drawings also shows the placement of the panel member 510 relative to the frontal striking surface of the golf club head 500. In this exemplary embodiment of the present invention, the top of the panel member 510 may generally be placed at a distance d2 of between about 8 mm to about 36 mm, more preferably between about 9 mm to about 24 mm, and most preferably about 10 mm. The bottom of the panel member 510 may be placed at a distance d3 of between about 13 mm to about 51 mm, more preferably between about 14 mm to about 45 mm, and most preferably about 15 mm. It should be noted here that distance d3 here is intentionally greater than the distance d2 in order to create the acoustic characteristics desired in the frontal acoustic chamber 520. In order to achieve the acoustic signature, a specific ratio between the distance d2 of the top and the distance d3 of the bottom is maintained between about 0.45 and 0.70, more preferably between about 0.50 and about 0.60, and most preferably about 0.55; which is referred to as the Panel Offset Ratio. The Panel Offset Ratio is defined here by Equation (2) below:

$$\text{Panel Offset Ratio} = \frac{\text{Distance } d2 \text{ of crown offset from frontal plane}}{\text{Distance } d3 \text{ of sole offset from frontal plane}} \quad \text{Eq. (2)}$$

FIG. 5 of the accompanying drawings also shows a specific geometry used to create the panel member 510 wherein the tri-facetted panel member 510 create a unique geometry wherein the center of the panel member 510 is further away from the striking face 502 to increase the volume of the frontal acoustic chamber 520. Alternatively speaking, it can be said that the panel member has a unique geometry wherein the center of the panel member 510 being placed further away from the striking face 502 than at the crown 504 and sole 506 portion of the panel member 510.

FIG. 5 of the accompanying drawings also shows more detail regarding the different facets created by the panel member 510 in creating the upper sub-panel member, the middle sub-panel member, and a lower sub-panel member. More specifically, a closer look at the panel member 510 in FIG. 5 shows that the upper sub-panel member may form an angle θ with the middle sub-panel member of between about 10 degree to about 15 degrees, more preferably between about 12 degrees to about 14 degrees, and most preferably about 13 degrees. The lower sub-panel member and the middle sub-panel member form an angle β of between about 16 degrees to about 20 degrees, more preferably between about 17 degrees to about 19 degrees, and most preferably about 18 degrees. It should be noted here that similar to the intentional difference between distances d2 and d3, the difference in the angle of the upper sub-panel member and the lower sub-panel member is intentional and critical in achieving the desired acoustic signature of the golf club head 500 as it alters the angle of the panel.

Finally, FIG. 5 shows a different attachment methodology for the crown 504 composite panel and the sole 506 composite panel, as it relates to the chassis of the golf club head 500. In this embodiment of the present invention, the crown 504 composite panel may generally be attached externally to the golf club head 500 via recesses created in the club head 500, wherein the sole 506 composite panel is attached internally to the golf club head 500 via the opening created in the crown 504 section. This combination of different attachment mechanisms is beneficial to the current invention because it allows different unique constructions that would previously be difficult to achieve. In one example, the internal attachment of the sole 506 composite piece would allow an internal rib to be added wherein such an internal rib would not be physically possible if the attachment was external. Although the present invention shows the crown 504 composite piece being external and the sole 506 composite piece being internal, the two attachment methodologies could be reversed with the crown piece 504 being installed internally without departing from the scope and content of the present invention.

Figure 6:
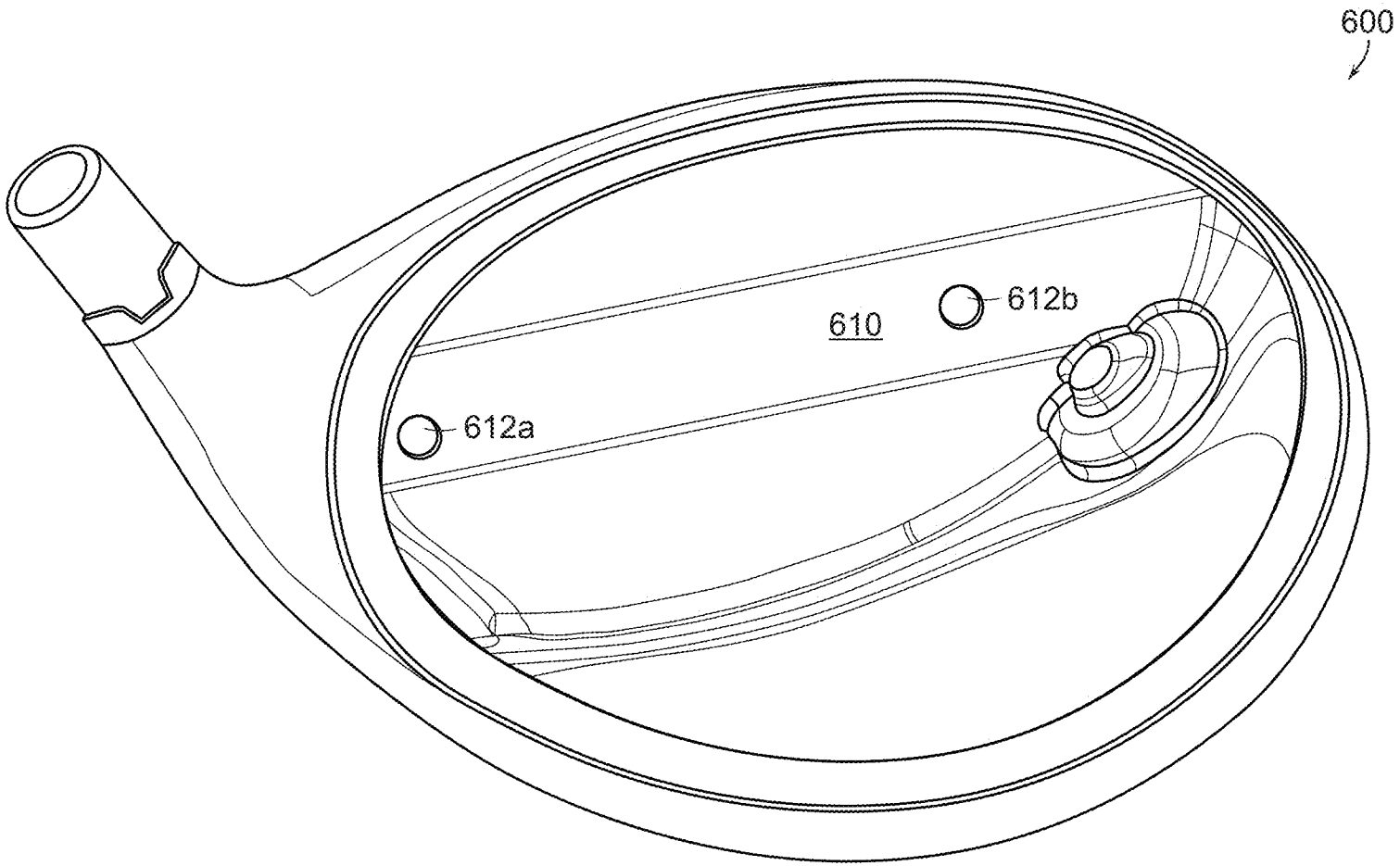
FIG. 6 of the accompanying drawings shows a partial rear perspective view of a golf club head in accordance with an alternative embodiment of the present invention.

FIG. 6 of the accompanying drawings shows a golf club head 600 in accordance with an alternative embodiment of the present invention wherein the panel member 610 does not need any ribs. This alternative embodiment still incorporates a facetted panel member 610 that separates the panel member 610 in to three separate sub-components, and still utilizes pressure release holes 612*a* and 612*b* to achieve the acoustic properties desired. It should be noted that the necessity and placement of the ribs and pressure releases holes 612*a* and 612*b* may generally depend on the shape, contour, and choice of materials of the golf club head 600 and the acoustic signatures that it generates, and either of these components may exist independent of one another without departing from the scope and content of the present invention. In this current embodiment shown in FIG. 6, the golf club head 600 may exhibit sufficient structural stiffness in the panel member 610 in the bottom, but the acoustic attenuation within the frontal acoustic chamber builds up too much pressure and requires a relief via the pressure release holes 612*a* and 612*b*.

Figure 7:
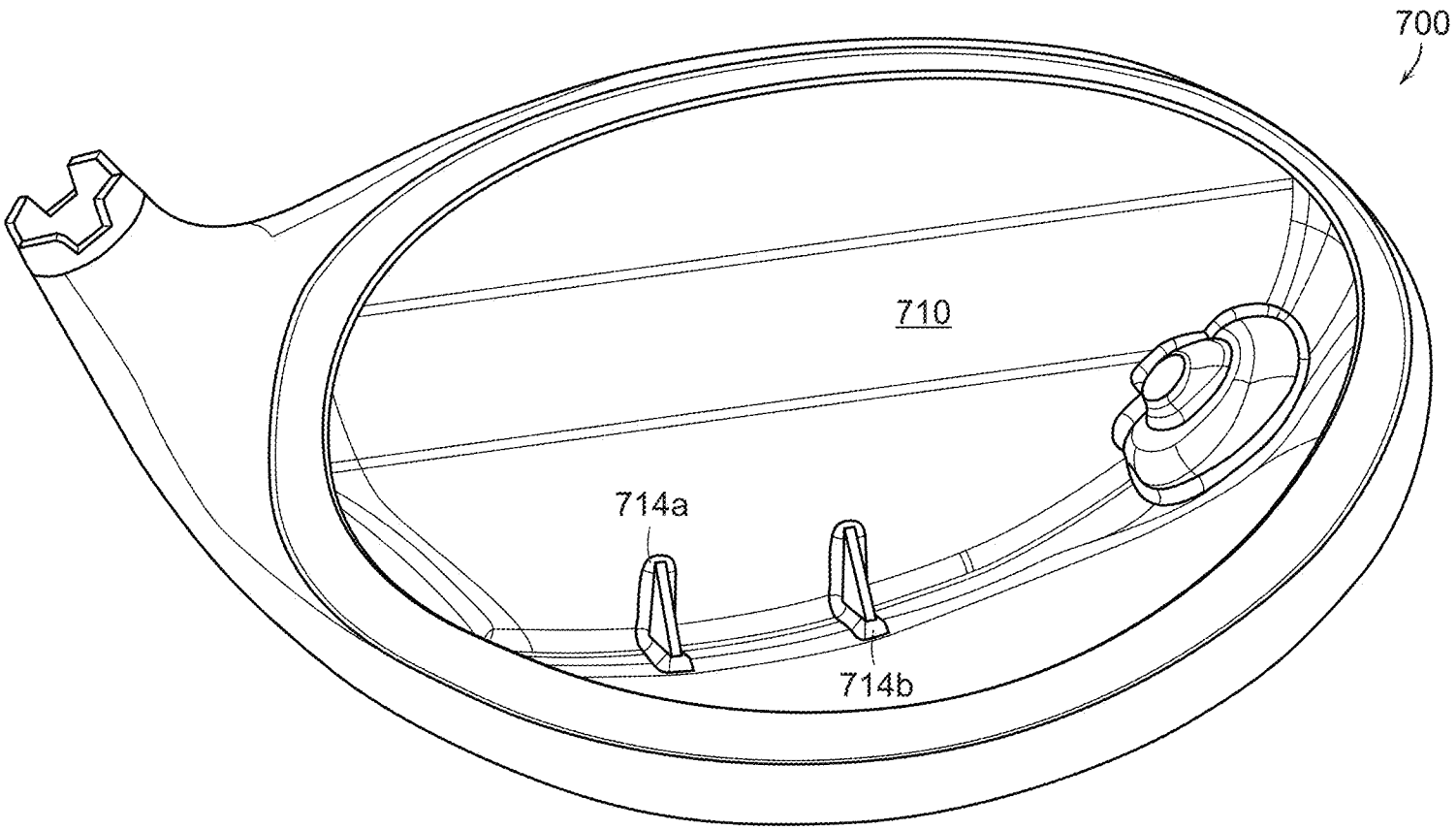
FIG. 7 of the accompanying drawings shows a partial rear perspective view of a golf club head in accordance with an alternative embodiment of the present invention.

In fact, FIG. 7 of the accompanying drawings shows exactly one of the alternative embodiments of the present invention wherein the golf club head 700 incorporates a plurality of ribs 714*a* and 714*b* without the need for pressure release holes. This embodiment may be preferred when the acoustic signature of the golf club head is undesirable due to the lack of stiffness in the bottom portion of the panel member 710.

Figure 8:
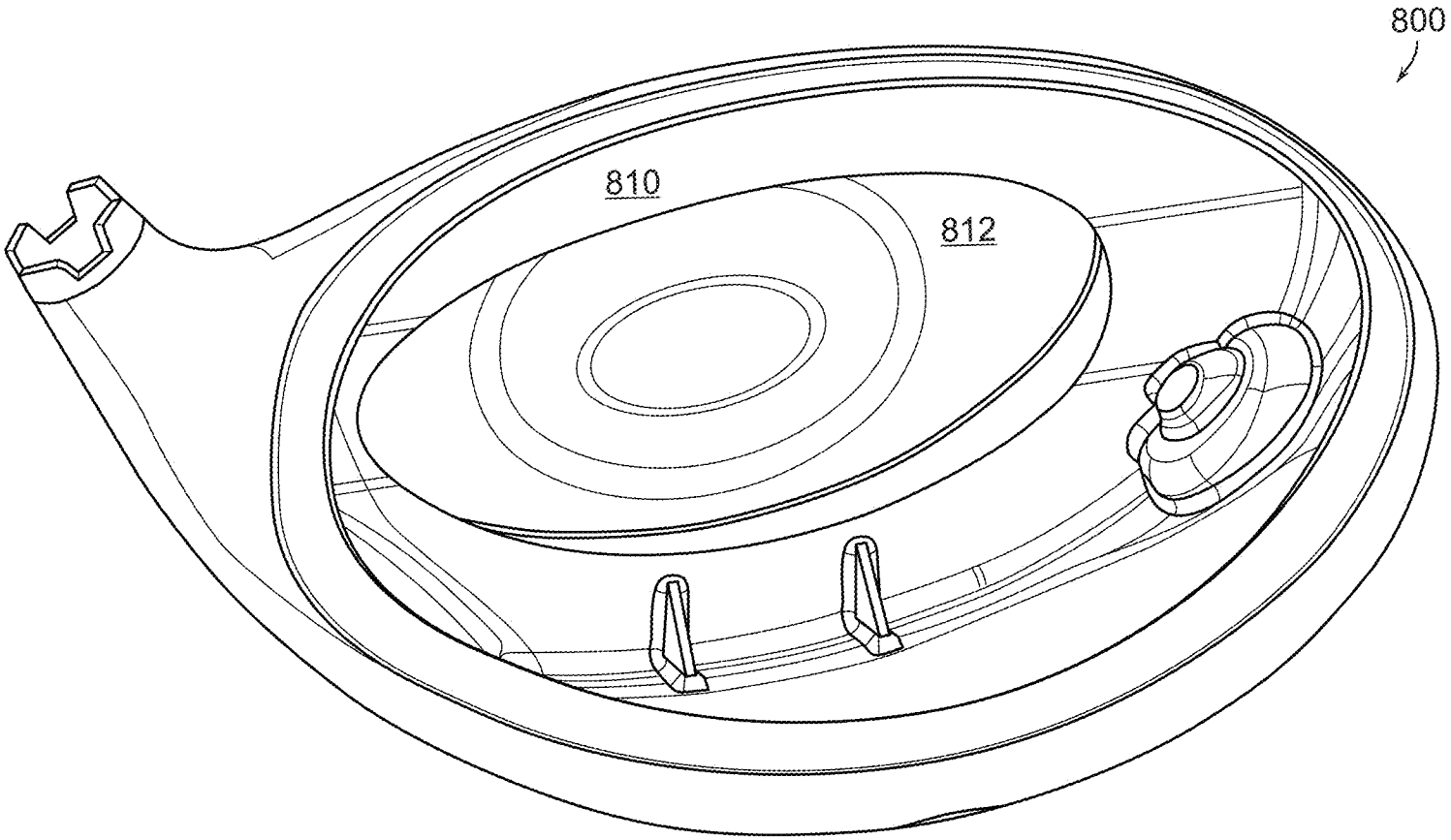
FIG. 8 of the accompanying drawings shows a partial rear perspective view of a golf club head in accordance with an even further alternative embodiment of the present invention.

FIG. 8 of the accompanying drawings shows a golf club head 800 in accordance with an alternative embodiment of the present invention wherein the panel member 810 that separates the frontal acoustic chamber and the rear weight saving chamber may be comprised out of one oversized pressure release hole 812 to help achieve differing acoustic frequencies that may be required for the golf club head 800. In this embodiment of the present invention, the area of the oversized pressure release hole 812 may generally be greater than about 2,000 $mm^2$, more preferably greater than about 2,200 $mm^2$, and most preferably greater than about 2,400 $mm^2$. The oversized pressure release hole 812 may be desired in situations wherein the acoustic properties of the golf club head 800 require such a design.

Figure 9:
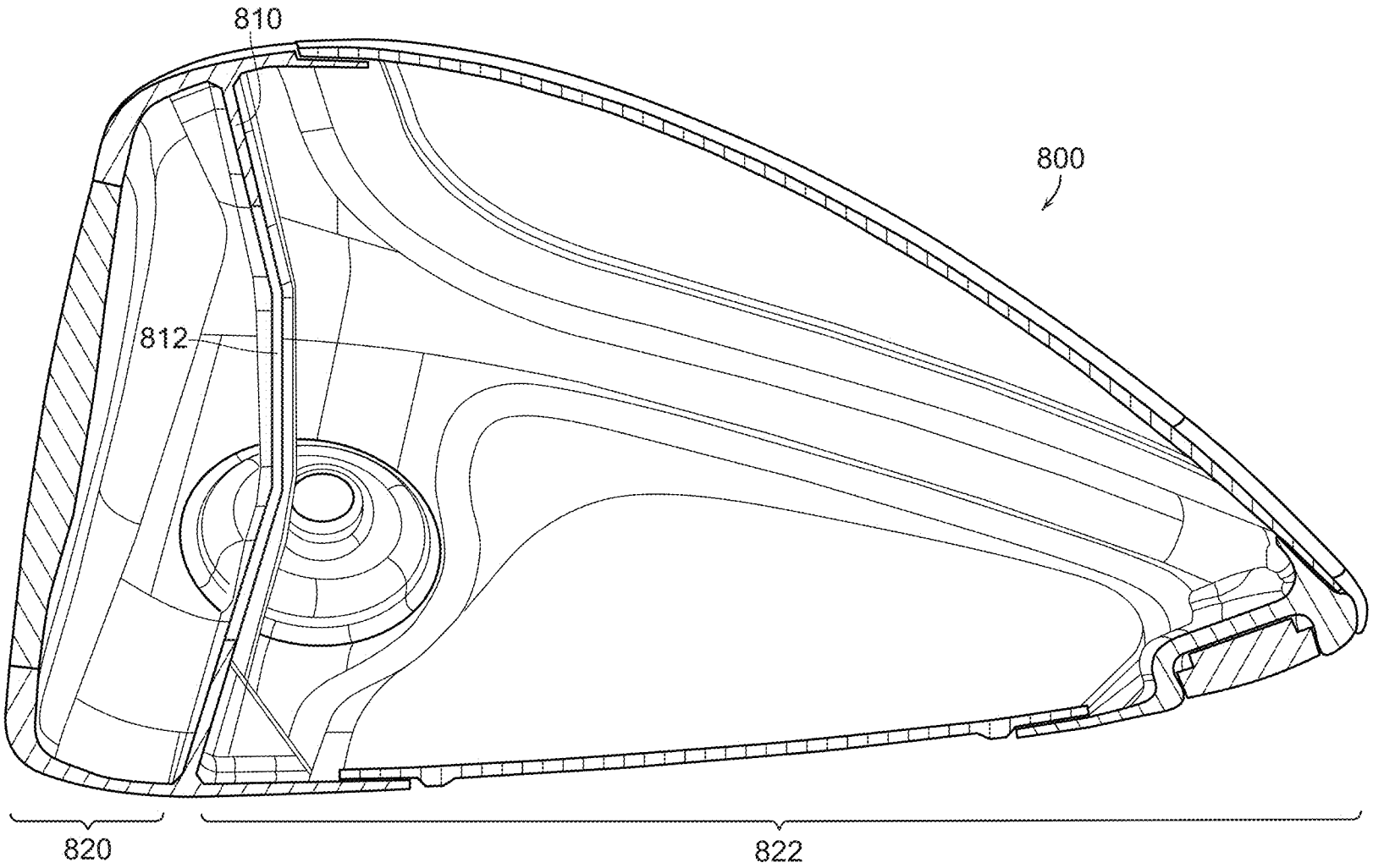
FIG. 9 of the accompanying drawings shows a cross-sectional view of a golf club head in accordance with a further alternative embodiment of the present invention.

In order to illustrate the relationship between the frontal acoustic chamber and the rear weight saving chamber in this alternative embodiment of the present invention, FIG. 9 is provided here showing a cross-sectional view of a golf club head 800 in accordance with an alternative embodiment of the present invention. In this cross-sectional view, it can be seen that the oversized pressure release hole 812 provides a large connection between the frontal acoustic chamber 820 and the rear weight saving chamber 822 not only for the acoustic properties as previously mentioned, but can also provide additional weight savings from the panel member 810 as well.

Figure 10:
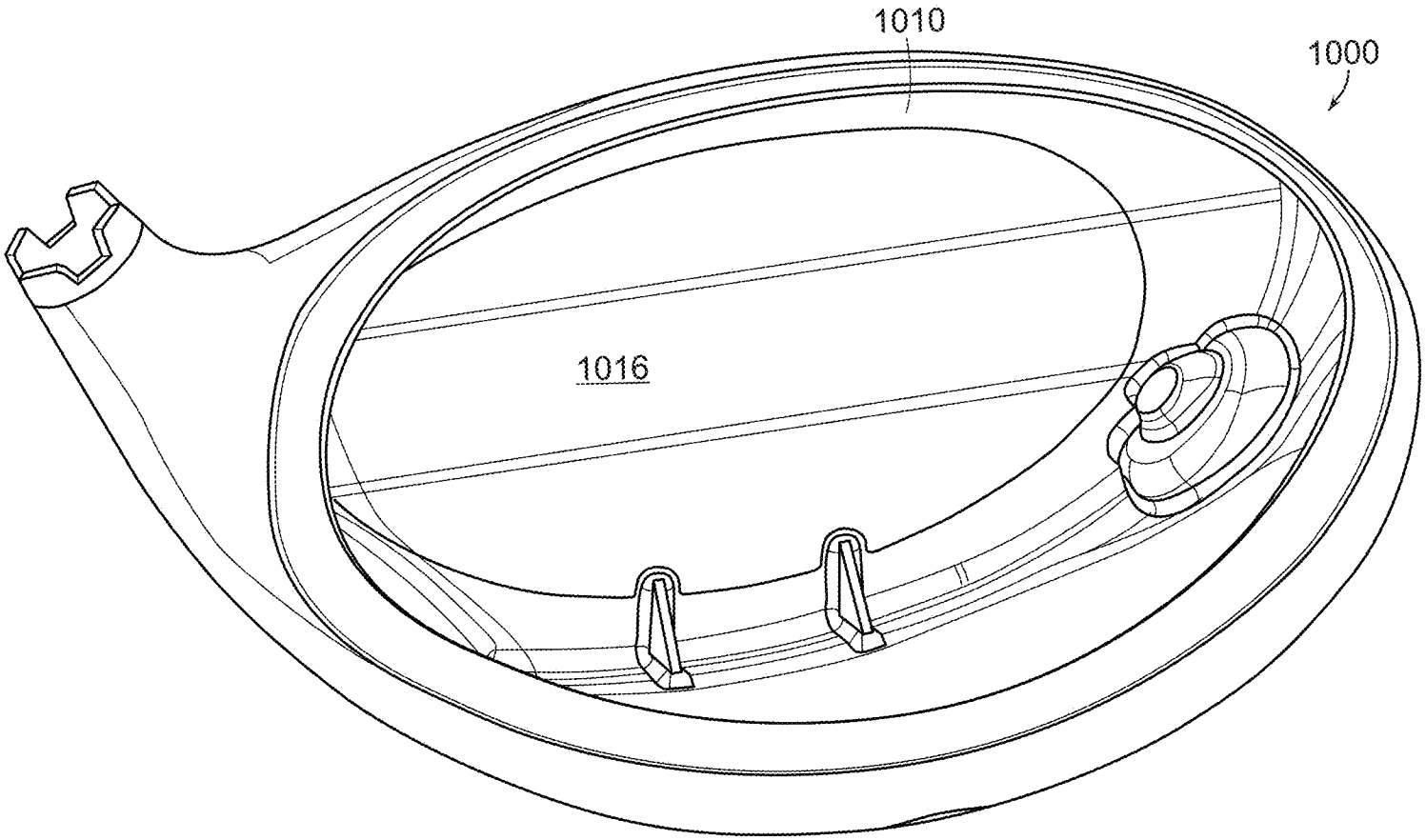
FIG. 10 of the accompanying drawings shows a partial rear perspective view of a golf club head in accordance with an alternative embodiment of the present invention.
Figure 11:
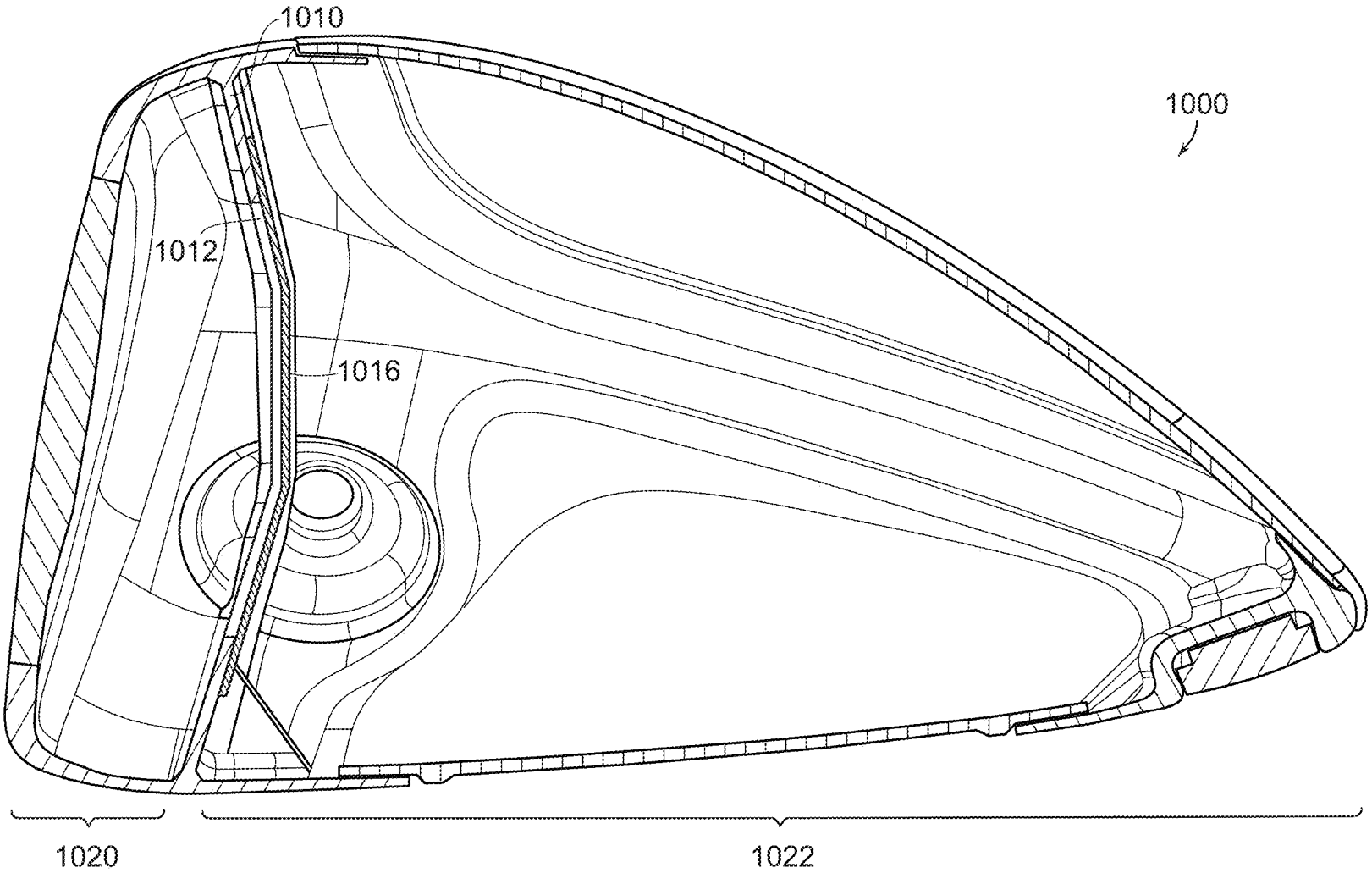
FIG. 11 of the accompanying drawings shows a cross-sectional view of a golf club head in accordance with an alternative embodiment of the present invention.

FIGS. 10 and 11 provide a rear opened view and a cross-sectional view of golf club heads 1000 in accordance with an alternative embodiment of the present invention wherein the oversized pressure release hole 1012 that is created on the panel member 1010 can be covered up by a lightweight panel 1016 to regain some of the acoustic characteristic and provide more separation between the frontal acoustic chamber 1020 and the rear weight saving chamber 1022. The lightweight panel 1016 may be attached using different means of attachment such as gluing, screwing, swaging, just to name a few. One thing to recognize is that because the placement of the lightweight panel 1016 is away from the frontal contact region, the stresses of impact are smaller, allowing more simplistic attachment means to be used.

Figure 12:
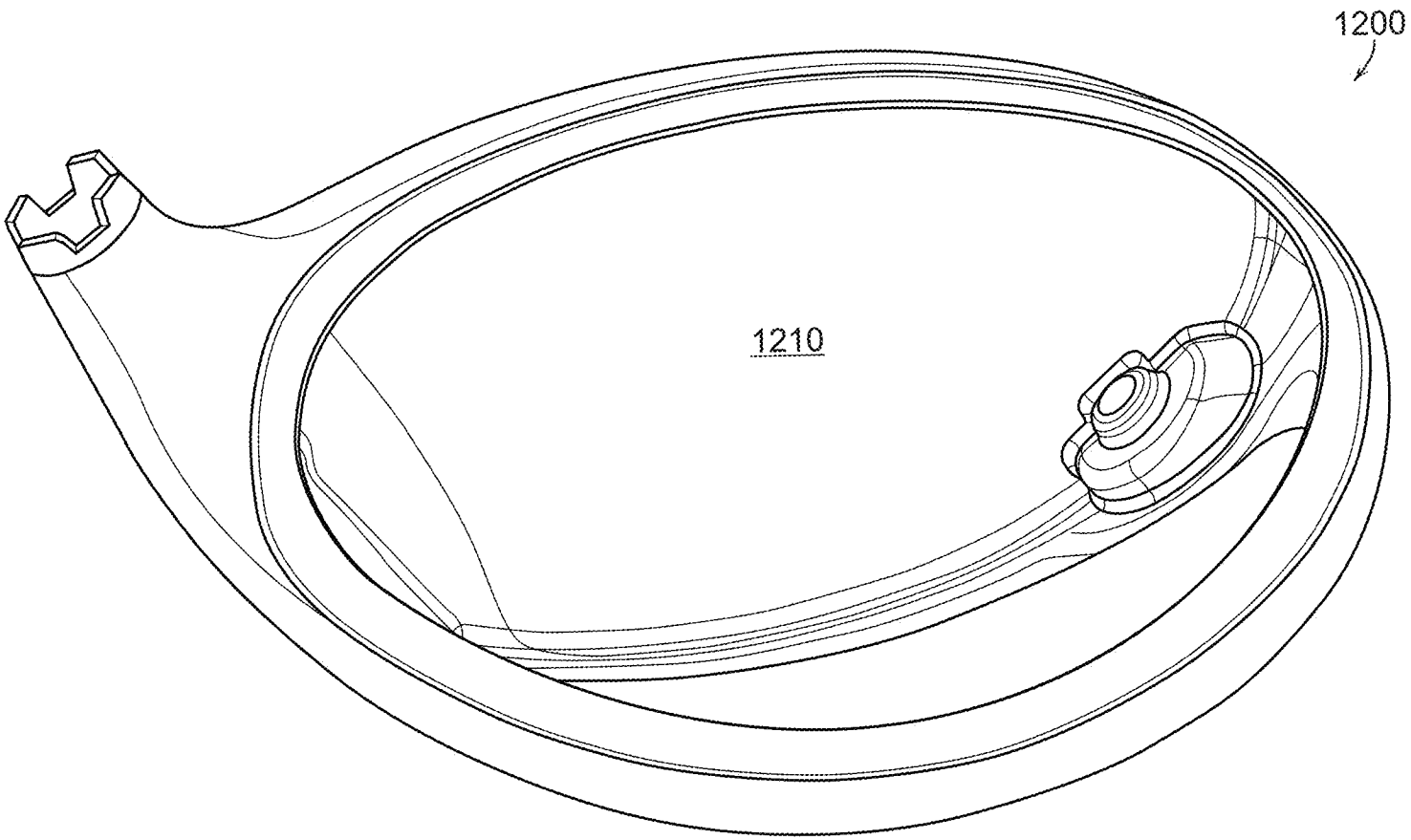
FIG. 12 of the accompanying drawings shows a partial rear perspective view of a golf club head in accordance with another alternative embodiment of the present invention.
Figure 13:
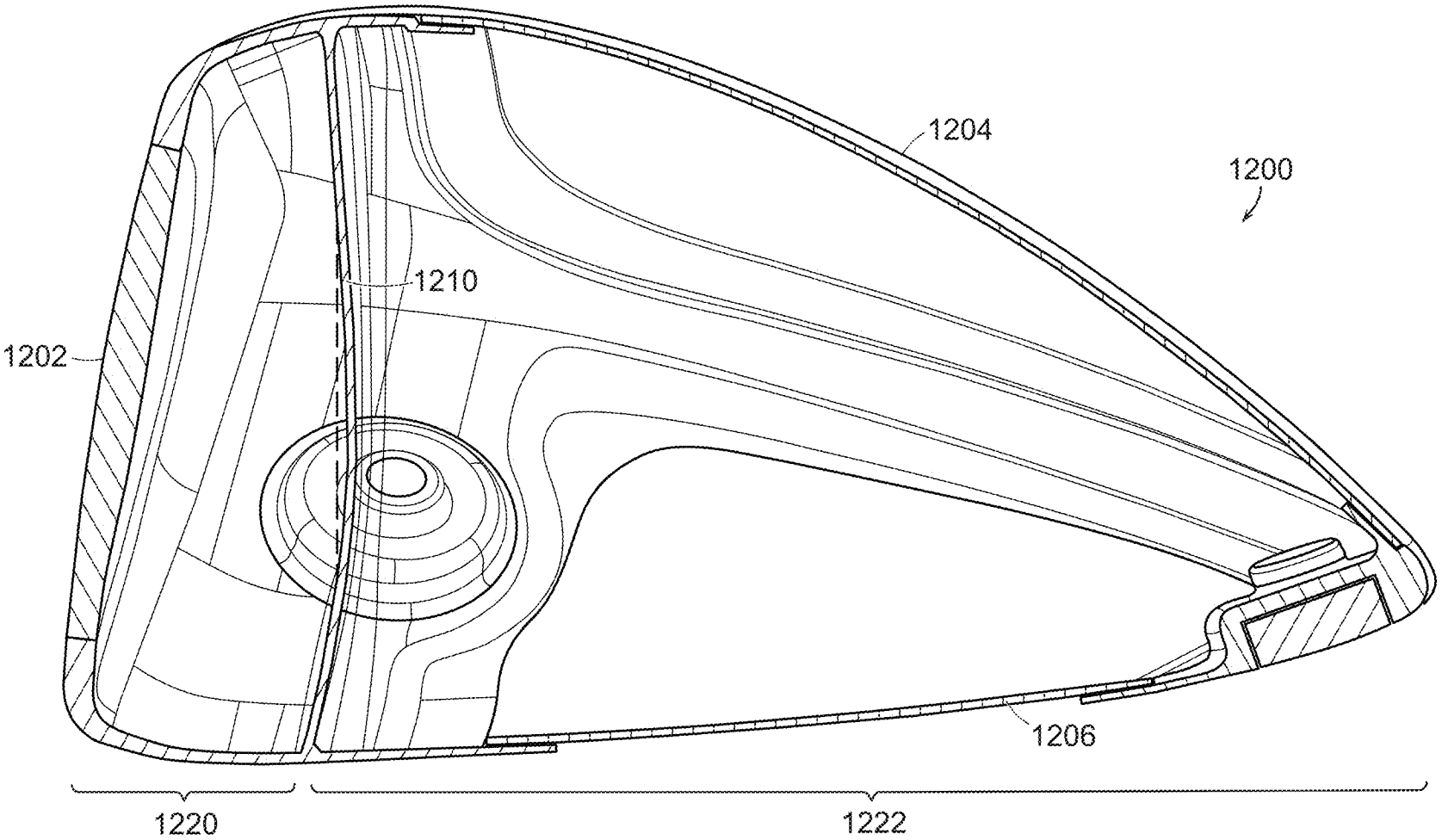
FIG. 13 of the accompanying drawings shows a cross-sectional view of a golf club head in accordance with another alternative embodiment of the present invention.

FIGS. 12 and 13 provide a rear opened view and a cross-sectional view of a golf club head 1200 in accordance with an alternative embodiment of the present invention wherein the panel member 1210 may take on a slightly different shape than previous embodiments. More specifically, FIGS. 12 and 13 show a golf club head 1200 wherein the panel member 1210 is curved away from the frontal portion of the golf club head 1200 instead of being facetted into three different zones as shown in previous embodiments. Alternatively it can be said that the shape of the panel member 1210 is continuously curved with the center of the panel member 1210 being placed further away from the striking face 1202 than at the crown 1204 and sole 1206 portion of the panel member 1210. Having a panel member 1210 that contains a continuous curvature is beneficial in certain embodiments wherein the acoustic signature of the frontal acoustic chamber 1220 requires more vibration, wherein the convergence points of the previous design would disrupts this vibration. In addition, the rear weight savings chamber 1222 may also benefit by minimizing the volume within that chamber. It should be noted although this embodiment of the present invention shown in FIGS. 12 and 13 does not incorporate any ribs or pressure release holes, they can be incorporated into this design depending on the acoustic needs of the golf club head 1200 without departing from the scope and content of the present invention.

Figure 14:
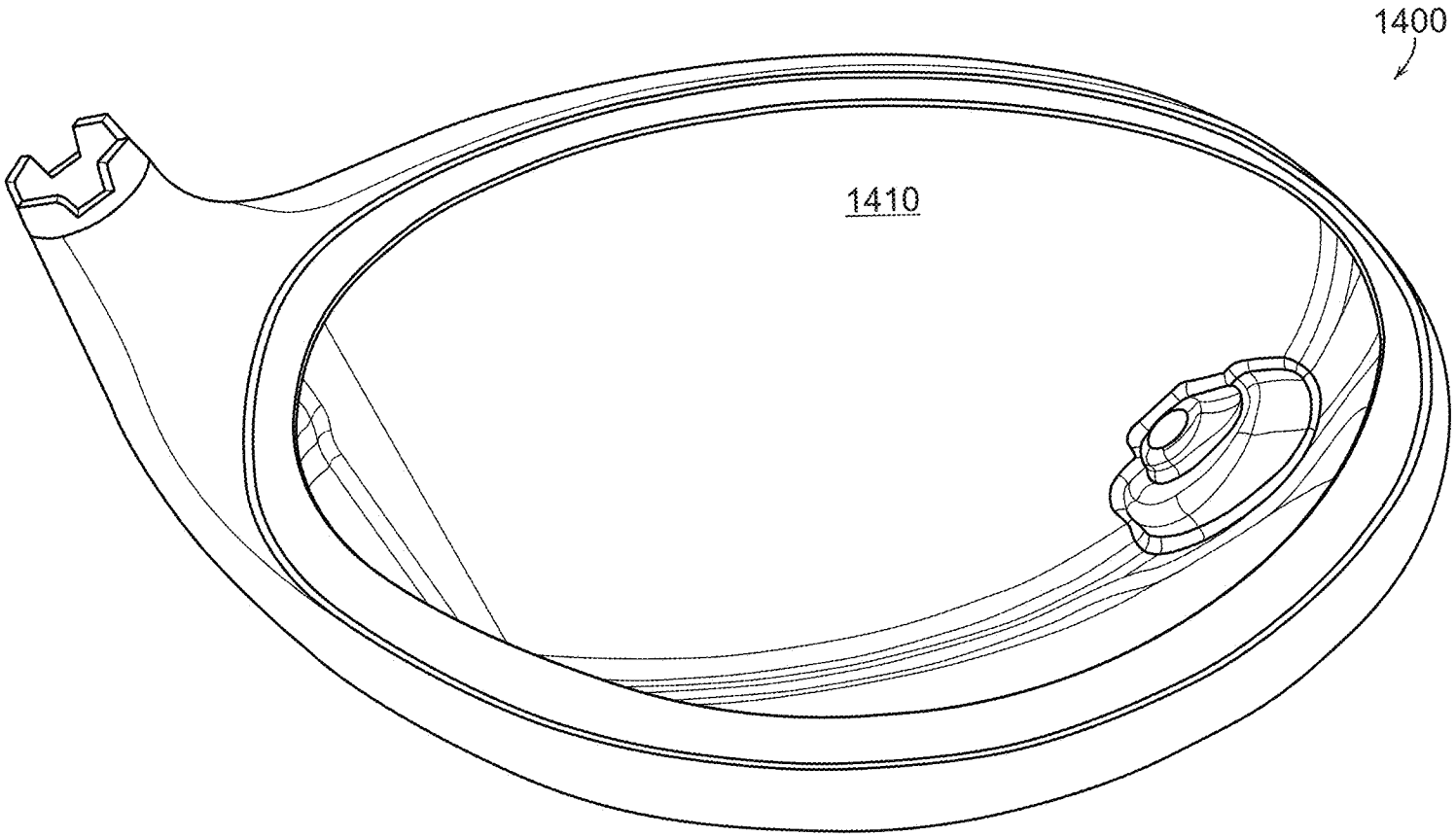
FIG. 14 of the accompanying drawings shows a partial rear perspective view of a golf club head in accordance with another alternative embodiment of the present invention.
Figure 15:
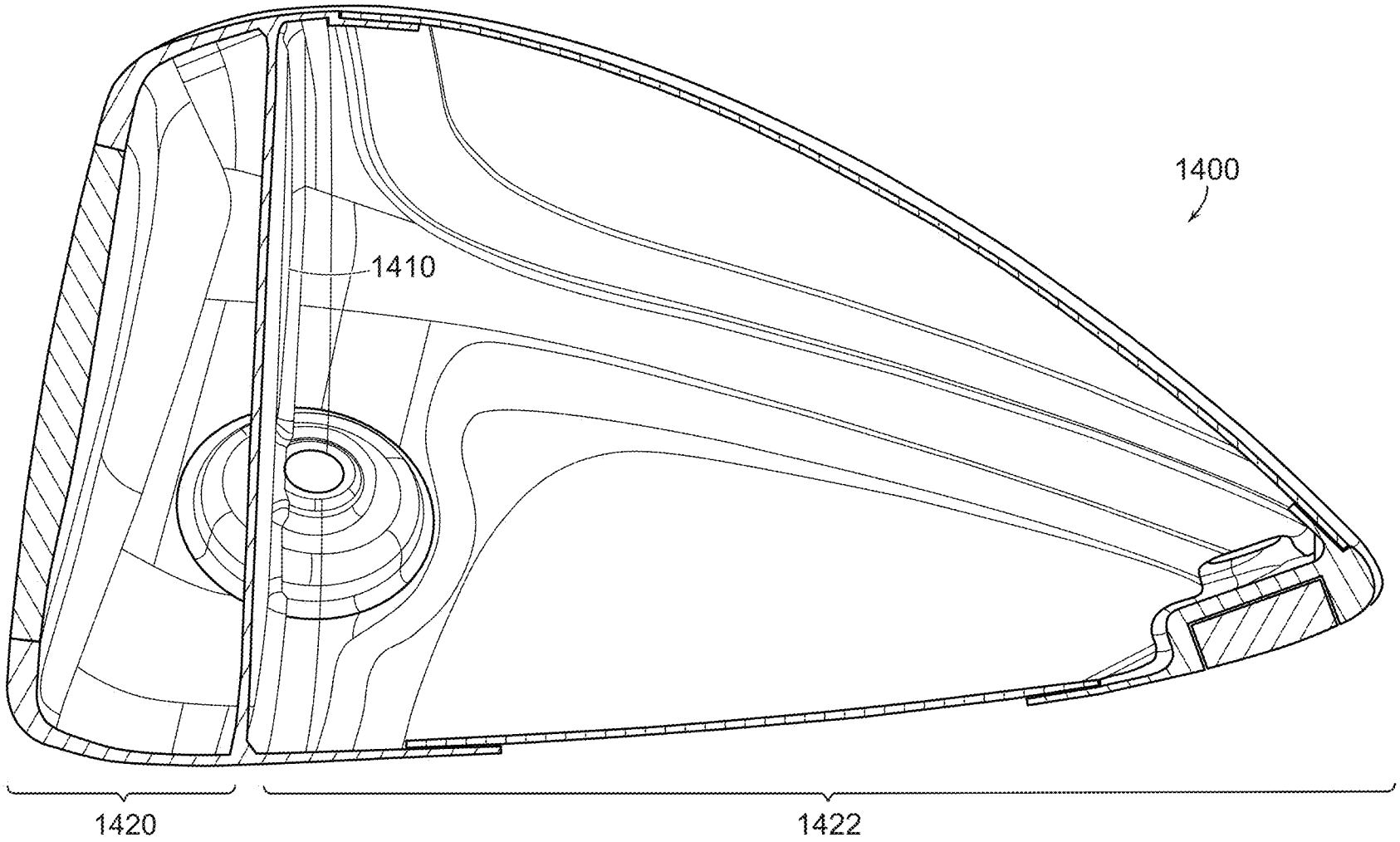
FIG. 15 of the accompanying drawings shows a cross-sectional view of a golf club head in accordance with another alternative embodiment of the present invention.

FIGS. 14 and 15 provides a rear opened view and a cross-sectional view of a golf club head 1400 in accordance with an even further alternative embodiment of the present invention wherein the panel member 1410 is a complete vertical wall. Having the panel member in the shape of a completely vertical wall is generally less desirable in creating the appropriate acoustic signature in the frontal acoustic chamber 1420, as a completely vertical panel member 1410 can hinder the ability of the golf club head 1400 to generate the vibration needed to achieve a desirable sound. Conversely, the rear weight saving chamber 1422 is adjusted accordingly. However, in extreme situations wherein the profile of the golf club head 1400 requires such a design, this alternative embodiment of the present invention will provide a golf club head 1400 that can achieve the acoustic signature required.

Figure 16:
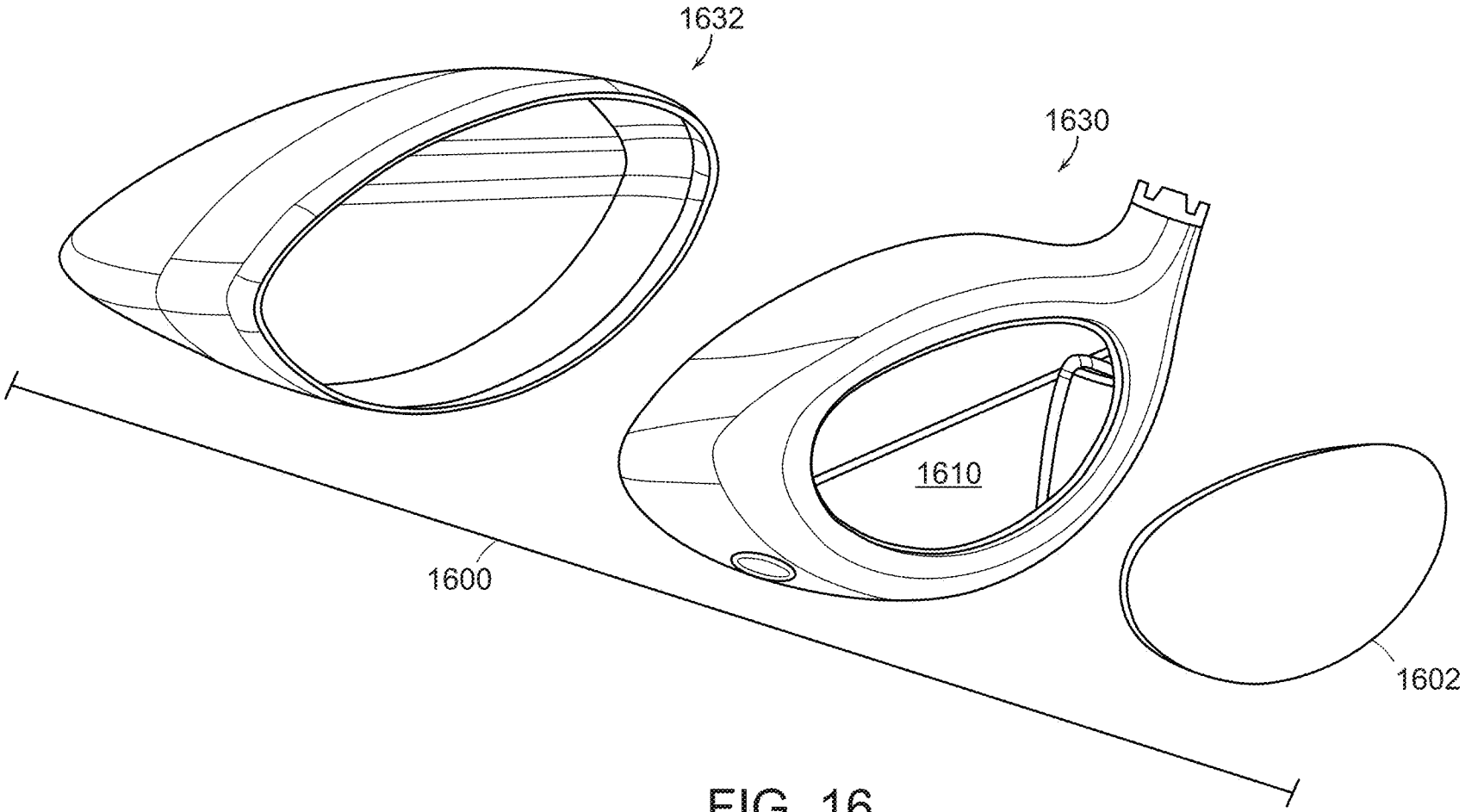
FIG. 16 of the accompanying drawings shows an exploded perspective of a golf club head in accordance with an even further alternative embodiment of the present invention.
Figure 17:
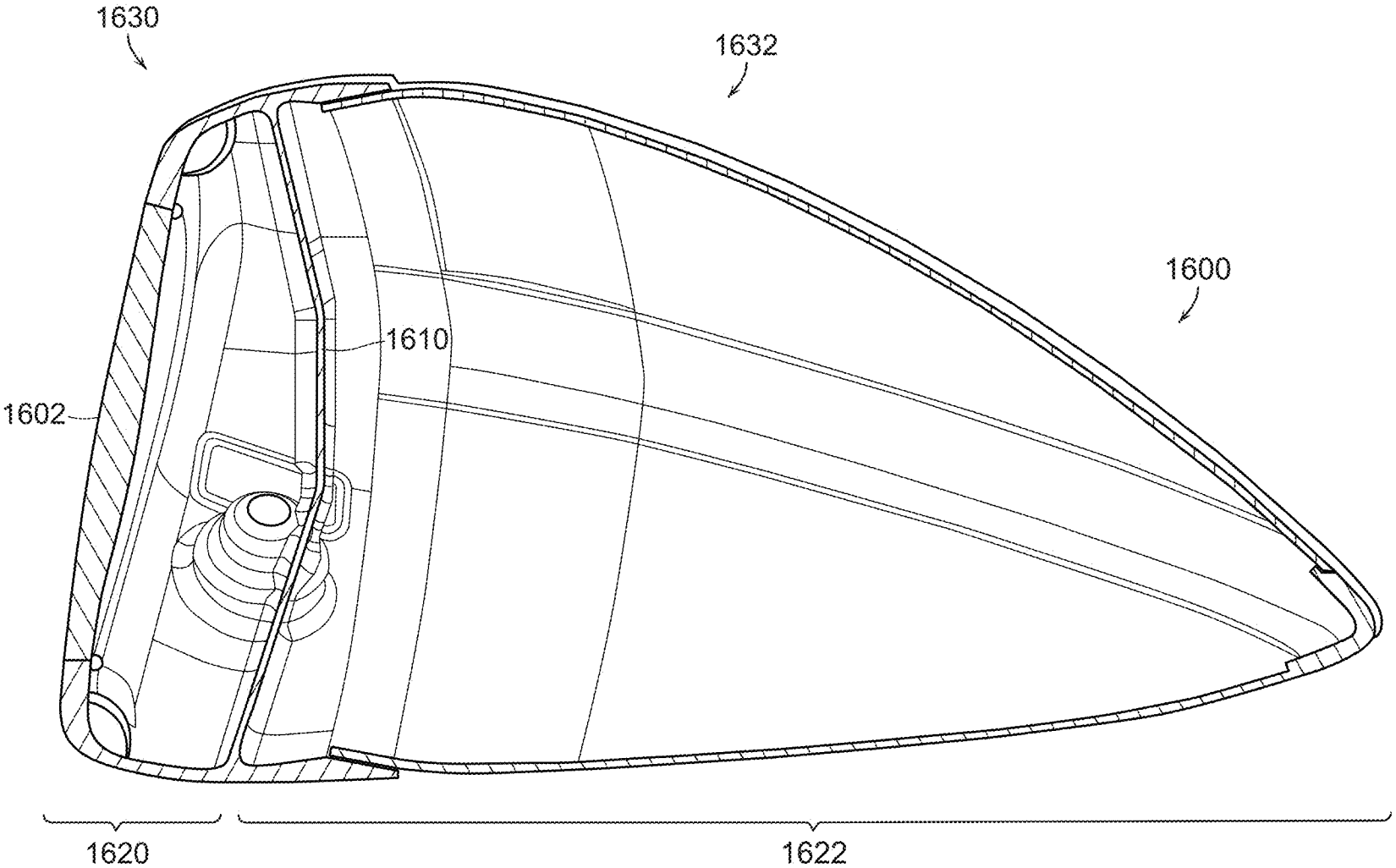
FIG. 17 of the accompanying drawings shows a cross-sectional view of a golf club head in accordance with an even further alternative embodiment of the present invention.

FIGS. 16 and 17 provide an exploded perspective view and a cross-sectional view of a golf club head 1600 in accordance with an even further alternative embodiment of the present invention. In this alternative embodiment of the present invention, the golf club head 1600 is separated into two separate components, a forward metallic portion 1630 and an aft composite portion 1632. It should be noted that the forward metallic portion 1630 and the aft composite portion 1632 refer to the external physical components that make up the golf club head 1600, while the frontal acoustic chamber 1620 and the rear weight saving chamber 1622 refer to internal components within the golf club head 1600. In this embodiment of the present invention, the external physical components of the golf club head 1600 are a striking face 1602, a forward metallic portion 1630 having a frontal opening and forming a panel member 1610, and an aft composite portion 1632. The exploded view of the golf club head 1600 shown in FIG. 16, especially when compared to the exploded view of the golf club head 400 (shown in FIG. 4) demonstrate the difference between the two embodiments of the present invention. More specifically, it can be seen here that the present embodiment shown in FIG. 16 completely removes any metallic components from the rear portion of the golf club head 1600, utilizing a completely composite material at the back half of the golf club head 1600 to further achieve weight savings.

In order to illustrate the relationship between the external physical components and the internal components, FIG. 17 is provided with a cross-sectional view of the golf club head 1600. In this cross-sectional view of the golf club head 1600, it can be seen that the frontal acoustic chamber 1620, similar to all previous embodiments, is completely formed by the forward metallic portion 1630. However, the aft composite portion 1632 shown in this cross-sectional view illustrates that the entirety of the back of the golf club head 1600 is made out of a composite material, making the frontal acoustic chamber 1620 even more important in creating the proper acoustic signature. In this embodiment of the present invention, the aft composite portion 1632 is joined to the forward metallic portion 1630 via a lap joint wherein the aft composite portion 1632 is underneath the forward metallic portion 1630. This type of unique construction of putting the composite material underneath the metallic material can be beneficial to the performance of the golf club head 1600, as it lends itself well to the utilization of internal ribs to provide structural rigidity to a composite material that tends to need such a support. However, it should be noted here that although the golf club head shown in this embodiment of the present invention shows a lap joint, numerous other types of joints may be used as long as it is capable of connecting the forward metallic portion 1630 and the aft composite portion 1632 without departing from the scope and content of the present invention.

A lot of the aforementioned discussion relates to the utilization of the frontal acoustic chamber to create a desirable acoustic signature for a golf club head using different designs and embodiments. Hence, this invention would be remiss if it did not provide more information regarding what acoustic signature it achieves.

Figure 18:
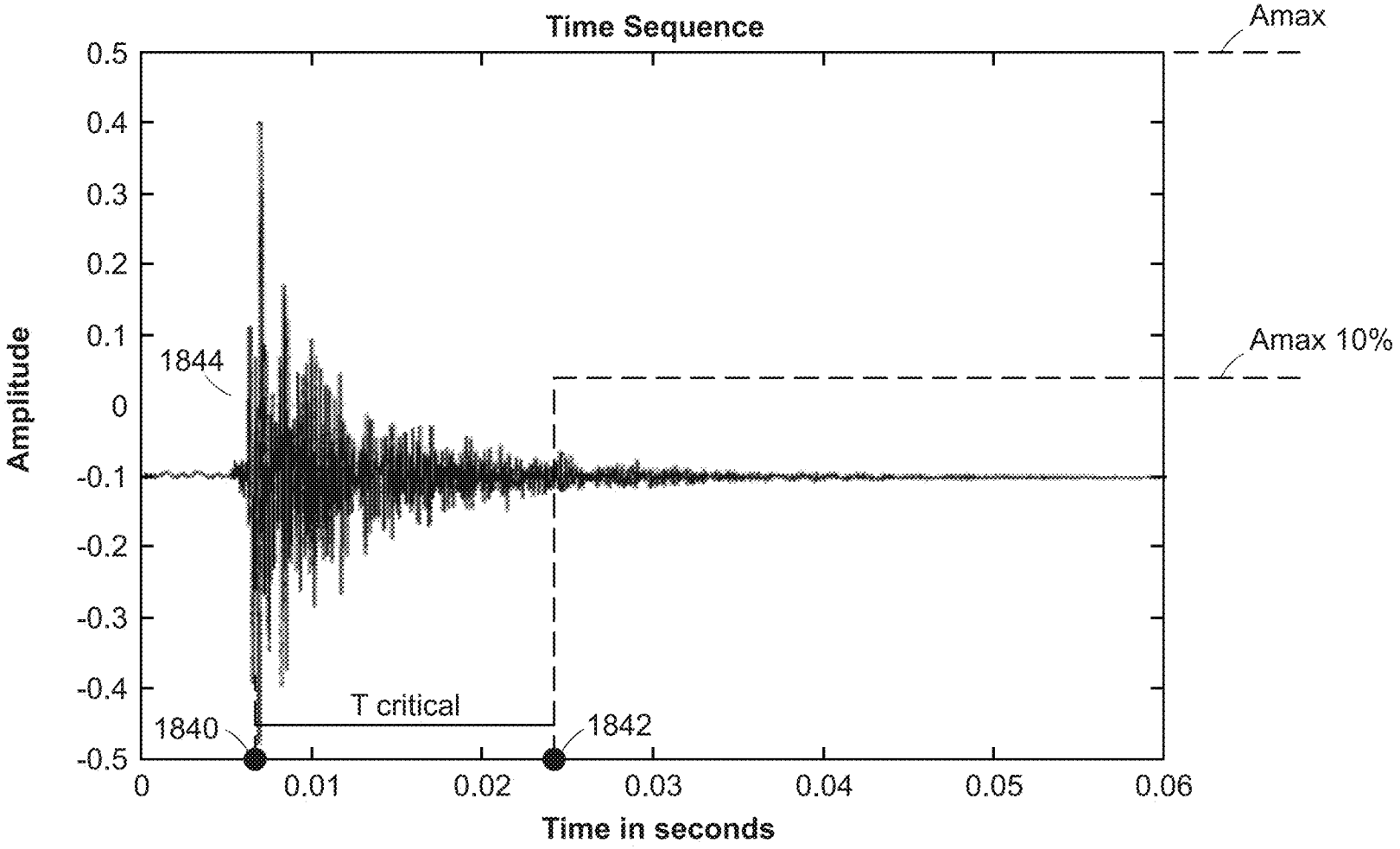
FIG. 18 of the accompanying drawings shows a time sequence diagram representing the amplitude of the sound of a golf club head in accordance with an embodiment of the present invention.

FIG. 18 of the accompanying drawing shows a time sequence diagram of the amplitude of the sound produced by the current inventive golf club head in accordance with an embodiment of the present invention. As the discussion previously indicated, the sound of the golf club head in accordance with the current inventive golf club head is one of the key factors in determining the performance of the golf club head. Before the discussion dives into the actual data, it is worthwhile to set forth the parameters of measurement of the present invention that will yield the results shown in FIG. 18. The time sequence diagram is created by gathering the audio profile using an audio recorder such as the TASCAM® DH-P2 Portable High Definition Stereo Audio recorder in conjunction with an A-weighting microphone. The recording is recorded at a distance of 39 inches away from the impact between the golf club head and the golf ball, which is determined as the distance that most closely simulates the distance to a golfer's ear as if he or she were hitting the golf club himself or herself. Data is sampled at 44.1 Hz to resolve the appropriate frequencies.

Moving onto the actual data shown in FIG. 18, we can see that on the x-axis, the time of the sound recording is shown in increments of 0.01 seconds; while on the other hand, on the y-axis shows the amplitude of the sound in millivolts. In the current sound recording shown in FIG. 18, it can be seen that the sound recording begins at a time 1844 right before impact with a golf ball and goes into a sinusoidal wave that reaches the peak amplitude $A_{max}$ at a time point 1840. Once the sound reaches the peak amplitude $A_{max}$ at time point 1840, the amplitude begins to resonate and begins decreasing until it dissipates completely. However, before it dissipates, it is worthwhile to note the point where the amplitude drops to beneath 10% of the peak amplitude $A_{max}$ it is of particular interest, as it defines a time point 1842 where the sound amplitude becomes borderline negligible to the naked ear. Due to the inherent oscillating tendencies of sound shown here in FIG. 18, the determination of when the sound oscillation actually reaches down to 10% of the peak amplitude $A_{max}$ can be difficult to discern visually. Hence, in order to help ease the determination, and in order to help pinpoint the oscillation variance inherent in these sound diagrams, the time where the amplitude is determined using a running average of the 5 most recent data points. In order to label this location of the 10% of the peak amplitude $A_{max}$ it is said to occur at time point 1842 shown in FIG. 18. In the current exemplary embodiment of the present invention, the peak amplitude $A_{max}$ is generally about 0.50 millivolts, occurring at a time point 1840 of about 0.007 seconds; while the diminished 10% peak amplitude $A_{max}$ occurs at a time point 1842 of about 0.025 seconds. The time that occurs between these the time points 1840 and 1842 is critical to recognize because it helps define a Critical Time $T_{critical}$. Critical Time $T_{critical}$ provides a way to quantify the quality and desirability of the sound of the golf club head as it impacts a golf ball. In the present embodiment of the present invention, the Critical Time $T_{critical}$ may be about 0.018 seconds.

A golf club head in accordance with the present invention may generally have a Critical Time $T_{critical}$ of greater than about 0.01 seconds and less than about 0.02 second, more preferably greater than about 0.015 seconds and less than about 0.02 seconds, and most preferably greater than about 0.0175 and less than about 0.02 seconds without departing from the scope and content of the present invention. Alternatively speaking, it can be said that the time it takes for the sound amplitude to go from the peak amplitude $A_{max}$ to an amplitude that is 10% of peak amplitude $A_{max}$ is defined as the Critical Time $T_{critical}$, and is generally greater than about 0.01 seconds and less than about 0.02 seconds, more preferably greater than about 0.015 seconds and less than about 0.02 seconds, and most preferably greater than about 0.0175 seconds and less than about 0.02 seconds.

Figure 19:
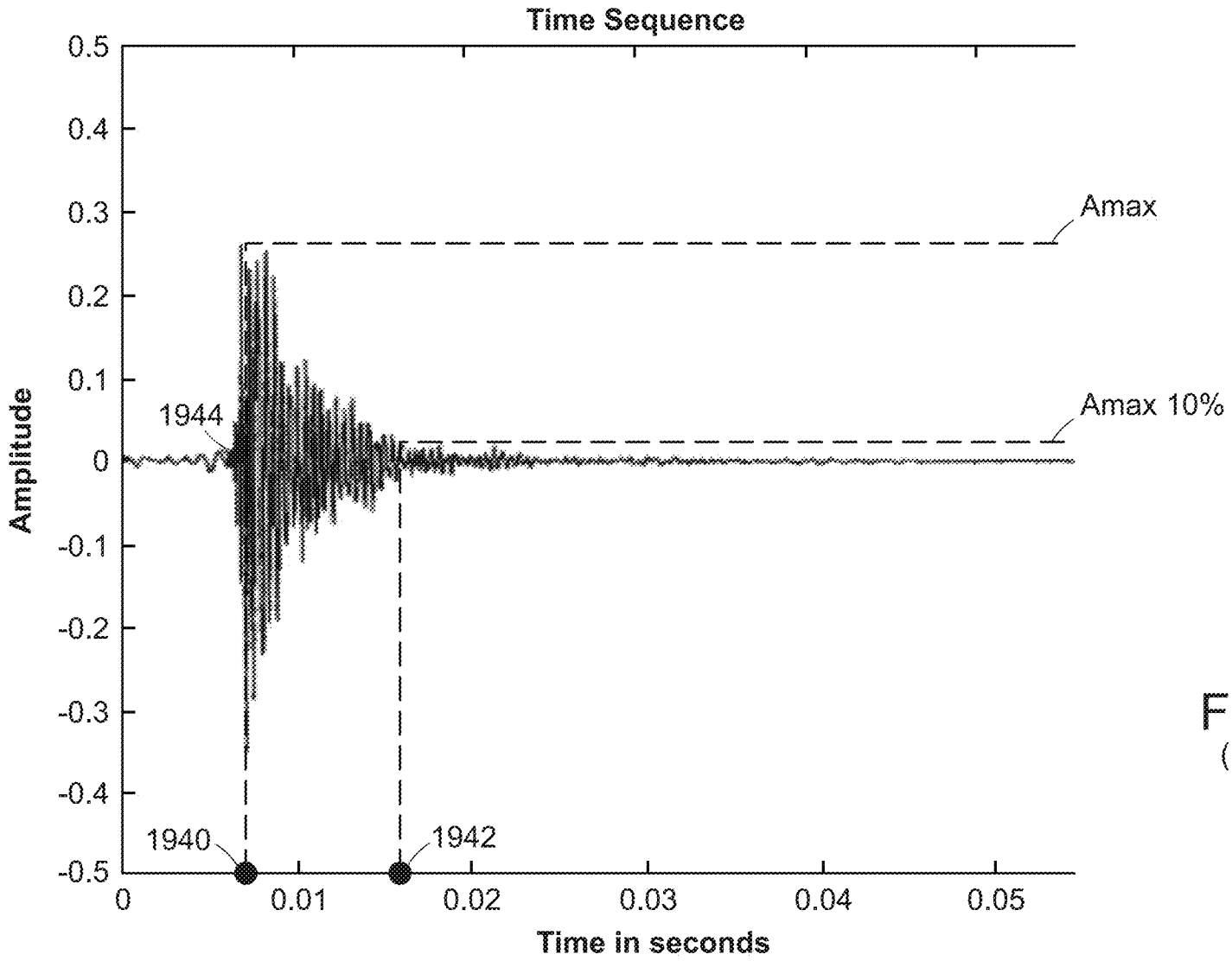
FIG. 19 (Prior Art)
FIG. 19 of the accompanying drawings shows a time sequence diagram representing the amplitude of the sound of an exemplary prior art golf club head.

FIG. 19 of the accompanying drawings provides an illustration of a time sequence diagram of a prior art golf club head that incorporates a composite crown technology that fails to recognize the importance of the sound component of a golf club head. As it can be seen from FIG. 19, not only the is peak amplitude $A_{max}$ significantly lower than the current inventive golf club head by being close to about 0.25 millivolts, it loses amplitude really quickly yielding a Critical Time $T_{critical}$ of less than about 0.01. In this exemplary prior art golf club head, the peak amplitude $A_{max}$ occurs at a time of about 0.008 second, while the diminished 10% of peak amplitude $A_{max}$ occurs at a time of about 0.015 second, yielding a Critical Time $T_{critical}$ of about 0.007 seconds, which is significantly less than the inventive golf club head $T_{critical}$ range of between about 0.01 seconds and 0.02 seconds. This prior art time sequence shown in FIG. 19 generally yields an undesirable sound, which the present invention avoids by adjusting the thickness ranges of the different materials and their respective layers.

Figure 20:
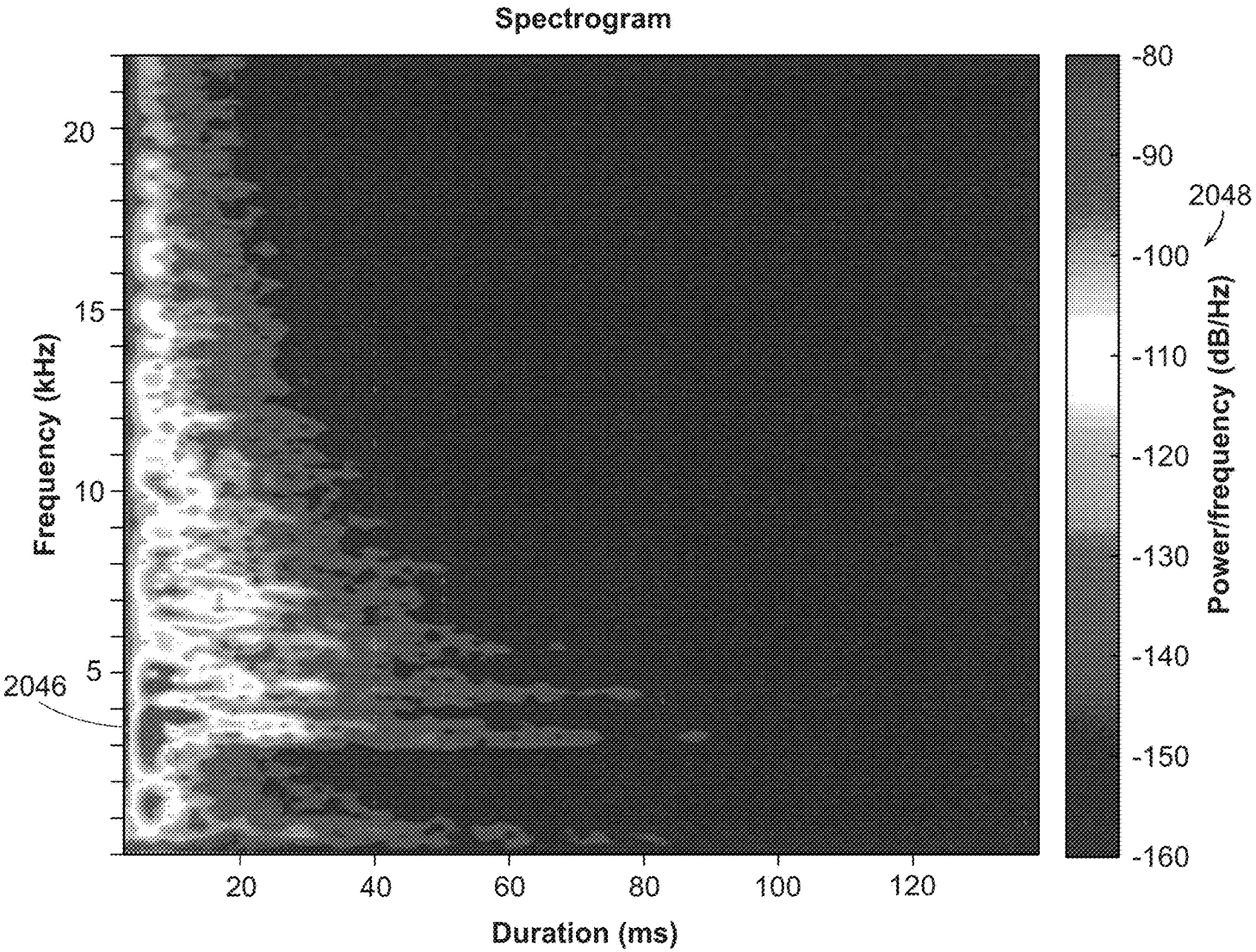
FIG. 20 of the accompanying drawings shows a spectrogram of the frequency and power of the sound of a golf club head in accordance with an embodiment of the present invention.

FIG. 20 provides more information regarding the acoustic signature of a golf club head that yields a desirable sound in accordance with the current inventive golf club head. Although the amplitude and duration of the sound is an important factor, it does not paint the entire picture about capturing the sound of a golf club head. More specifically, the third component in accurately capturing the sound of a golf club head is the frequency of the sound emitted by the golf club head during impact with a golf ball. FIG. 20 provides exactly this information by presenting a spectrogram that provides a visual representation of the spectrum of frequency of sound as it varies over time. Although the spectrogram provided in FIG. 20 contains a lot of information, the key feature to focus on is the dominant acoustic frequency 2046 occurring at a frequency that is above 3500 Hz. The dominant frequency is determined by the shading decided in the power/frequency chart 2048 on the right of the spectrogram itself shown in FIG. 20.

Figure 21:
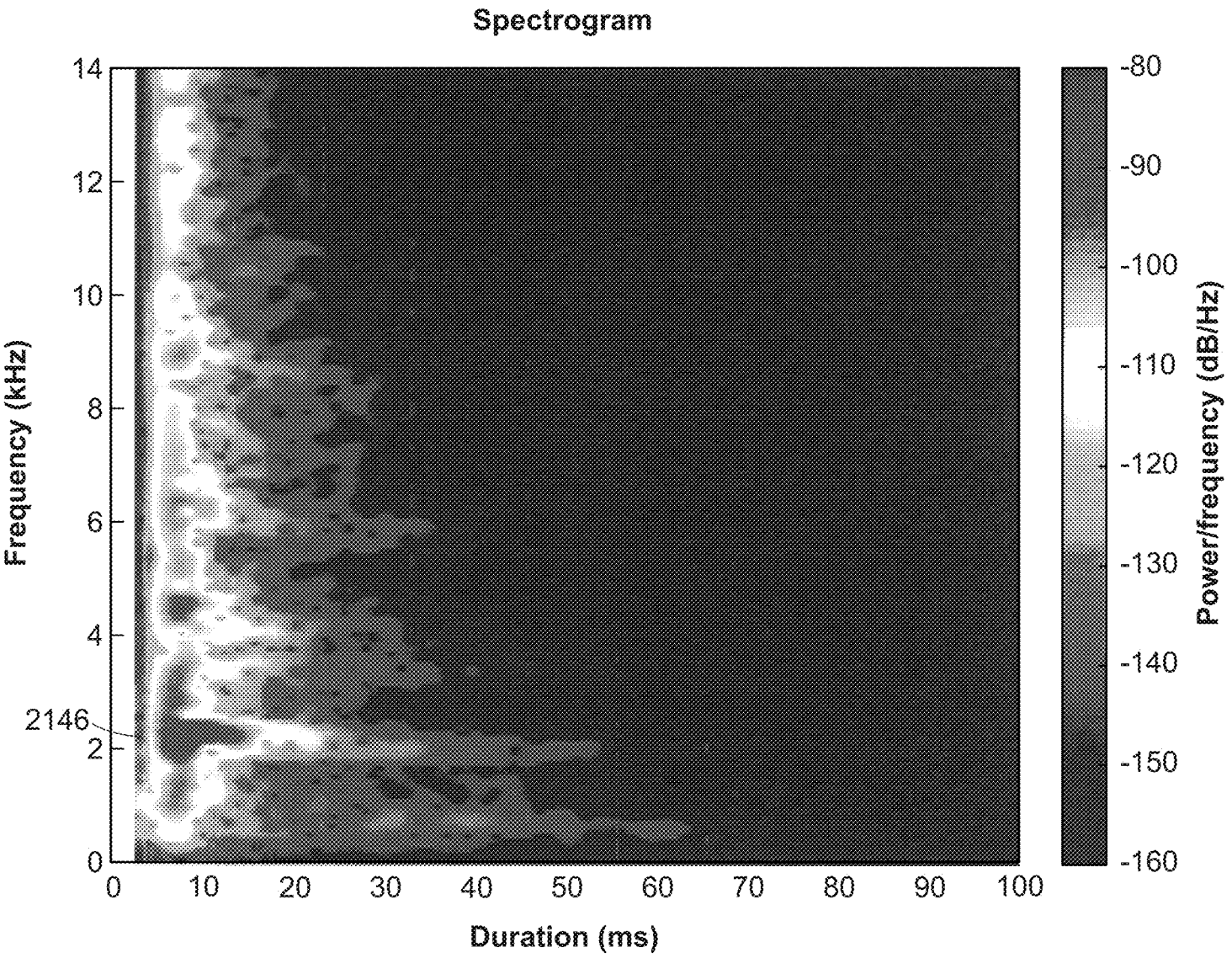
FIG. 21 (Prior Art)
FIG. 21 of the accompanying drawings shows a spectrogram of the frequency and power of the sound of a golf club head in accordance with a prior art golf club head.

Similar to the discussion above regarding the amplitude of the current inventive golf club head, to truly appreciate the difference in the spectrogram of the acoustic signature of the current golf club head, a prior art golf club head that contains an undesirable acoustic signature is presented here in FIG. 21. FIG. 21 of the accompanying drawings provides a spectrogram of a prior art golf club head that has composite material that produces an undesirable acoustic signature. Even a cursory examination of the spectrogram shown in FIG. 21 shows a clear difference from the current inventive golf club head spectrogram shown in FIG. 20. More specifically, a closer examination of FIG. 21 one can see that the dominant acoustic frequency 2146 occurs at a frequency that is significantly less than 3500 Hz, at a frequency of about 2100 Hz. This deficiency of frequency of 1100 Hz between this prior art golf club head and the current inventive golf club head, combined with the fast over damping of the amplitude of the golf club head explains the difference in a desirable acoustic signature and an undesirable acoustic signature previously discussed.

Finally, it is worth noting here that the panel member here may generally have its own resonant frequency of greater than 3300 Hz, which when combined with the other structures of the golf club head may yield the golf club head resonant frequency articulated above.

Figure 22A:
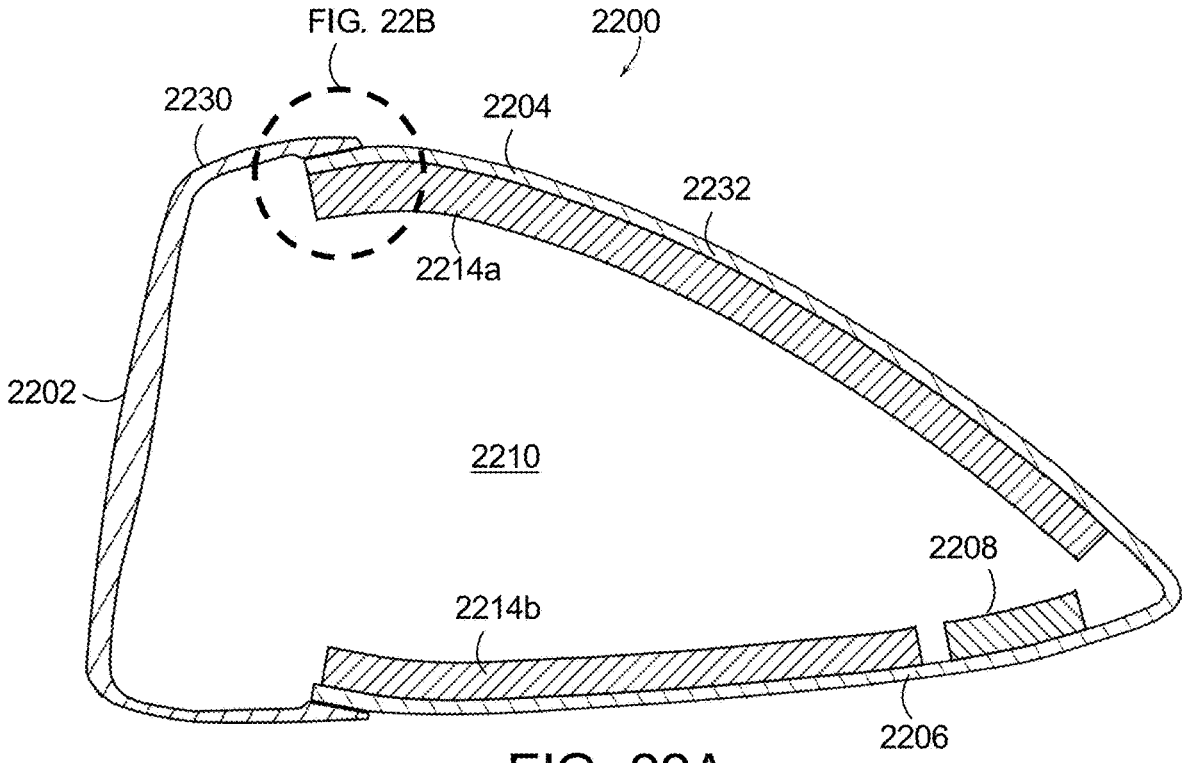
FIG. 22A of the accompanying drawings shows a cross-sectional view of a golf club head in accordance with an embodiment of the present invention.

FIG. 22A of the accompanying drawings shows a cross-sectional view of a golf club head 2200 in accordance with an embodiment of the present invention. Similar to the golf club 1600 described above with reference to FIGS. 16 and 17, the golf club head 2200 depicted in FIG. 22A includes a forward portion 2230 and an aft portion 2232. In some examples, the forward portion 2230 may be made from a metallic material and the aft portion 2232 may be made from a non-metallic or composite material. In other examples, the forward portion 2230 may also be made at least partially of a composite material. The forward portion 2230 may be made from a material or combination of materials that has an effective density referred to as the first density, and the aft portion 2232 may be made from a material of combination of materials that has an effective density referred to as the second density. As discussed above, the second density may be lower than the first density. In some examples, if the aft portion 2232 includes additional structures, such as weights, those weights may be may be removed from the determination of the effective density of the aft portion 2232. For example, any structures in the aft portion 2232 that have a density greater than three times the other materials of the aft portion 2232, those structures may be excluded from the calculation or determination of the effective density of the aft portion 2232.

The golf club head 2200 includes a striking face 2202, a crown 2204, and a sole 2206. Each of those components is formed from portions of the forward portion 2230 and/or the aft portion 2232. A cavity 2210 is formed between the crown 2204, the striking face 2202, and the sole 2206.

The thickness of the aft portion 2232 in some examples may be less than 0.8 mm, and in some examples may be between 0.4 mm and 0.6 mm or less than about 0.5 mm. Due in part to the thin shell of the aft portion 2232, a plurality of ribs 2214 are also included in the interior of the aft portion 2232. For example, a crown aft rib 2214*a* may be attached to the interior surface of the aft portion 2232 at the crown 2204, and a sole aft rib 2214*b* may be attached to the interior surface of the aft portion 2232 at the sole 2206. The crown aft rib 2214*a* extends from the forward edge, or near the forward edge, of the aft portion 2232 and extend towards the rearmost point of the aft portion 2232. For instance, the crown aft rib 2214*a* may extend from about 0-3 mm from the forward edge of the aft portion 2232. In some examples, the crown aft rib 2214*a* may have length that is equal to the length of the aft portion 2232 measured a direction from the striking face 2202 to the rearmost point of the aft portion 2232. The crown aft rib 2214*a* may also extend from the forward edge of the aft portion 2232 all the way to the rearmost point of the interior surface of the aft portion 2232. In other examples, crown aft rib 2214*a* may have a length that is greater than about 80% or about 60% to 80% of the length of the aft portion 2232. The sole aft rib 2214*b* also extends from the forward edge of the aft portion 2232 to the rearmost point of the aft portion 2232. The length of the sole aft rib 2214*b* may be equal to the length of the aft portion 2232 measured a direction from the striking face 2202 to the rearmost point of the aft portion 2232. In some examples, the sole aft rib 2214*b* may also extend from the forward edge of the aft portion 2232 all the way to the rearmost point of the interior surface of the aft portion 2232. In other examples, the sole aft rib 2214*b* may have a length that is greater than about 80% or about 60% to 80% of the length of the aft portion 2232. A weight 2208 may also be included in the aft portion 2232. For example the weight 2208 may be positioned between the rearmost end of the sole aft rib 2214*b* and the rearmost point of the aft portion 2232.

The crown aft rib 2214*a* and/or the sole aft rib 2214*b* may be made from the same material as the aft portion 2232. In some examples, the crown aft rib 2214*a* and/or the sole aft rib 2214*b* may be made from a different material than the aft portion 2232. For example, the crown aft rib 2214*a* and/or the sole aft rib 2214*b* may be made from a material having a Young's Modulus value greater than the Young's Modulus value for material of the aft portion 2232. By having a stiffer material used for the crown aft rib 2214*a* and/or the sole aft rib 2214*b*, additional support is provided the aft portion 2232, resulting in a higher durability.

Figure 22B:
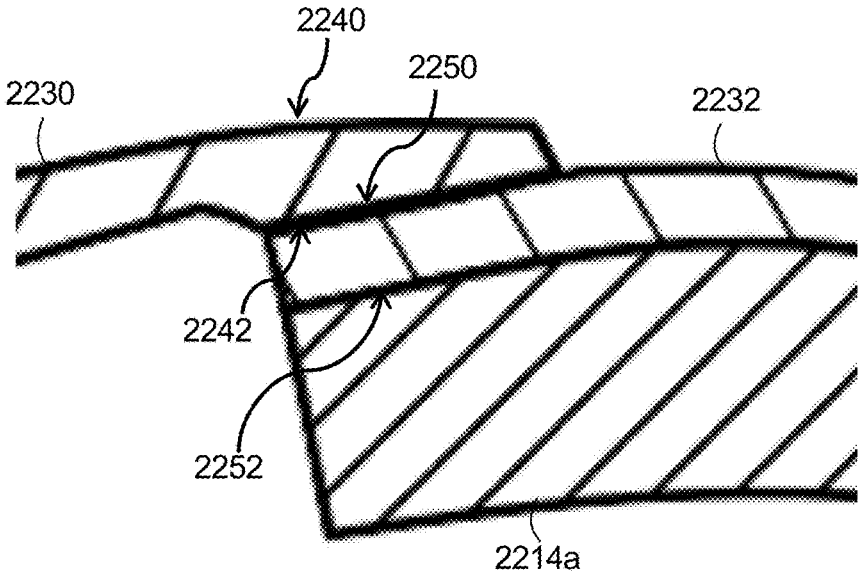
FIG. 22B of the accompanying drawings shows an enlarged view of a joint of the club head depicted in FIG. 22A in accordance with an embodiment of the present invention.

The forward portion 2230 and the aft portion 2232 are joined at a joint that is shown in further detail in FIG. 22B. FIG. 22B of the accompanying drawings shows an enlarged view of a joint of the golf club head 2200 depicted in FIG. 22A in accordance with an embodiment of the present invention. The aft portion includes an opening towards the forward portion, and the joint extends continuously around the circumference of the opening. The forward portion 2230 and the aft portion 2232 are joined together via a taper joint. A taper joint is used to join the forward portion 2230 and the aft portion 2232 to improve the durability of the golf club head 2200. As compared to a lap joint to connect the forward portion 2230 and the forward portion 2230 (which can be seen as the joint connecting the crown to the forward portion of golf club 1400 depicted in FIG. 15), the taper joint provides for a reduced likelihood of a failure at the joint. For example, when the golf club head 2200 strikes a golf ball, the golf club head experiences a substantial amount of force and stress. In particular, a substantial amount of stress is applied to the joint, and the joint is often the most likely point for failure. With a standard lap joint, the stress and force experienced during a golf ball strike causes the outermost portion (the crown in FIG. 15) to experience a peeling force that encourages the outermost portion to peel away from the inner portion (the forward portion in FIG. 15). The use of the taper joint reduces the peeling force tendency. The inclusion of the ribs 2214 also strengthens the joint and reduce the likelihood of a failure at the joint. The use of the ribs 2214 and the taper joint also allows for the joint section (e.g., the area where the forward portion 2230 and the aft portion 2232 overlap) to be reduced.

As depicted in FIG. 22B, at the taper joint, the forward portion 2230 includes a forward joint section that has a forward joint section exterior surface 2240 and a forward joint section interior surface 2242. The forward joint section exterior surface 2240 is the surface of the forward portion 2230 that faces the exterior of the golf club head 2200. The forward joint section interior surface 2242 is the surface of the forward portion 2230 that faces the interior of the golf club head 2200. Similarly, at the taper joint, the aft portion 2232 includes an aft section joint that has an aft joint section exterior surface 2250 and a aft joint section interior surface 2252. The aft joint section exterior surface 2250 is the surface of the aft portion 2232 that faces the exterior of the golf club head 2200. The aft joint section interior surface 2252 is the surface of the aft portion 2232 that faces the interior of the golf club head 2200. At the taper joint, the aft joint section exterior surface 2250 is in contact with the forward joint section interior surface 2242. The aft joint section exterior surface 2250 may be attached to the forward joint section interior surface 2242 via an adhesive or other bonding application. The crown aft rib 2214*a* is attached to the aft joint section interior surface 2252 and extends in a direction away from the striking face 2202, as also shown in FIG. 22A.

Figure 22C:
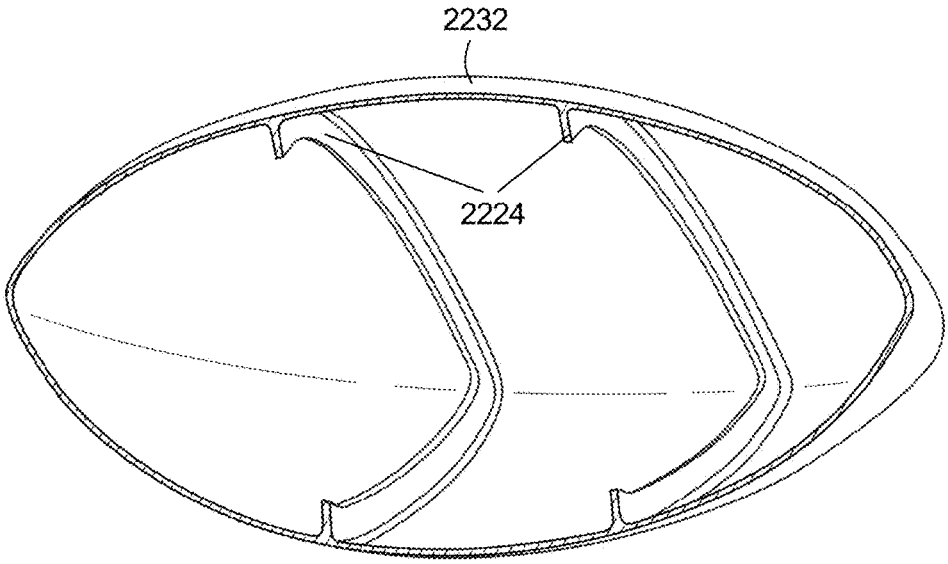
FIG. 22C of the accompanying drawings shows a perspective view of an aft portion of another embodiment of a golf club head in accordance with an embodiment of the present invention.

FIG. 22C of the accompanying drawings shows a perspective view of an aft portion 2232 of a golf club head in accordance with an embodiment of the present invention. In the embodiment depicted, two continuous aft ribs 2224 are attached to the interior surface of the aft portion 2232. Each continuous aft rib 2224 extends from first location on a first half of the interior surface of the aft portion 2232 to a second location on a second half of the interior surface of the aft portion 2232. For instance, the continuous aft rib 2224 may extend from the forward edge of the interior surface of the aft joint section at the crown to the forward edge of the aft joint section at the sole, as depicted in FIG. 22C. In some examples, at least one surface of the continuous aft rib 2224 is entirely in contact with the interior surface of the aft portion 2232. The continuous aft ribs 2224 may be made from the same material as the aft portion 2232. In some examples, the continuous aft ribs 2224 may be made from a different material than the aft portion 2232. For example, the continuous ribs 2224 may be made from a material having a Young's Modulus value greater than the Young's Modulus value for material of the aft portion 2232. By having a stiffer material used for the continuous ribs 2224, additional support is provided to the joint and the aft portion 2232, resulting in a higher durability. In some examples, however, where the difference in stiffness is too large, such as the continuous ribs 2224 being made of a material that is significantly stiffer than the remainder of the aft portion 2232, the continuous ribs 2224 may tear through the remainder of the aft portion 2232. Accordingly, in some examples, the Young's Modulus value for the continuous ribs 2224 is no greater than the 120% of the Young's Modulus value for the material of the aft portion 2232. In another example, where the aft portion 2232 is made from a fiber reinforced plastic, fiber may also be used in the continuous aft ribs 2224. In one example, the fiber used in the aft portion 2232 may have a lower Young's Modulus value than the fiber used in the continuous aft ribs 2224.

Figure 22D:
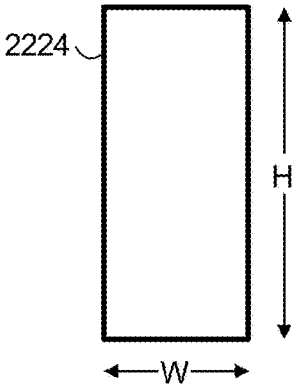
FIGS. 22D-22F of the accompanying drawings show cross-section views of example profiles of an aft rib in accordance with embodiments of the present invention.
Figure 22E:
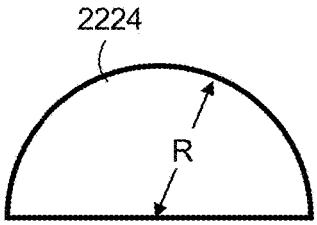
Figure 22F:
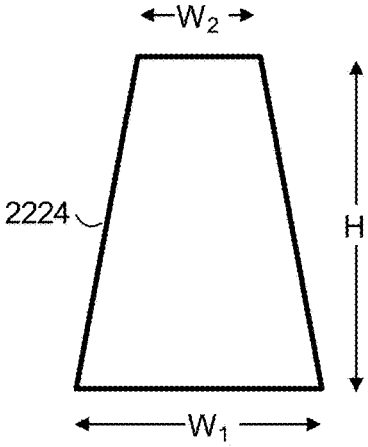

FIGS. 22D-22F of the accompanying drawings show cross-section views of example profiles of an aft rib 2224 in accordance with embodiments of the present invention. In FIG. 22D, a rectangular profile for the aft rib 2224 is shown. The rectangular profile for the aft rib 2224 can also be seen in FIG. 22C. The rectangular profile of the aft rib 2224 has a height (H) and a width (W). In some examples, the width (W) may be about 0.5 mm and the height may be about 2 mm. In other examples, the width may be about the same width as the thickness of the outer shell of the aft portion 2232. The height (H) of the rib may be greater than or equal to the width (W) of the rib 2224. In FIG. 22E, a round profile for the rib 2224 is shown. The round profile has a radius (R). In some examples, the radius (R) is approximately equal to the thickness of the outer shell of the aft portion 2232. In other examples, the radius (R) may be about 0.5 mm. In FIG. 22F, a trapezoidal profile for the rib 2224 is shown. The trapezoidal profile has a first width ($W_1$) for the wide base, a height (H), and a second width ($W_2$) for the short base. The wide base is the portion of the profile attached to the interior surface of the aft portion 2232. In some examples, the first width ($W_1$) may be about 0.5 mm or about equal to the thickness of the outer shell of the aft portion. The second width ($W_2$) is less than the first width ($W_1$), and may be about 0.3 mm. In some examples the second width ($W_2$) is less than or equal to about 80% or 60% of the first width ($W_1$). The height (H) may be greater than or equal to first width ($W_1$). In some examples, the height may be about four times greater than the first width ($W_1$). By using a round profile or a trapezoidal profile, additional weight savings for a golf club head may be achieved as the total volume of the rib may be reduced.

Figure 22G:
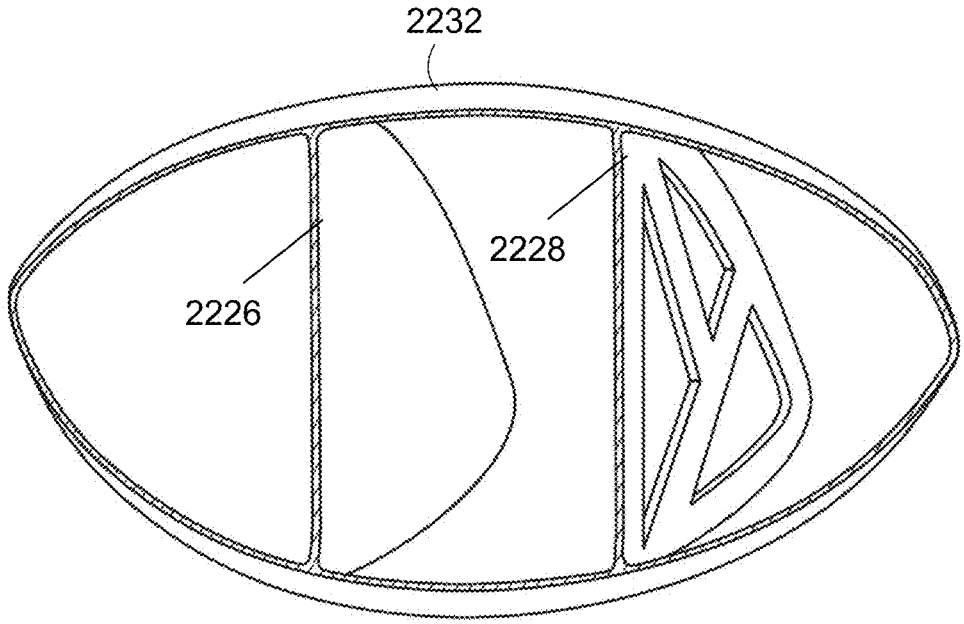
FIG. 22G of the accompanying drawings shows a perspective view of an aft portion of another embodiment of a golf club head in accordance with an embodiment of the present invention.

FIG. 22G of the accompanying drawings shows a perspective view of an aft portion 2232 of a golf club head in accordance with an embodiment of the present invention. In the embodiment depicted, a panel 2226 and/or a brace 2228 may be used rather than the continuous aft ribs 2224 depicted above in FIG. 22C. In some examples, the panel 2226 and/or the brace 2228 may be used in addition to the continuous aft ribs 2224. The panel 2226 and/or the brace 2228 may be made of the same materials as the continuous aft ribs 2224. The panel 2226 is a generally planar piece of material. The brace 2228 is similar with the exception that some material has been removed, which may provide for weight savings in the golf club head. The width of the panel 2226 and/or the brace 2228 may be any of the widths discussed above with reference to the continuous aft ribs 2224.

Figure 23A:
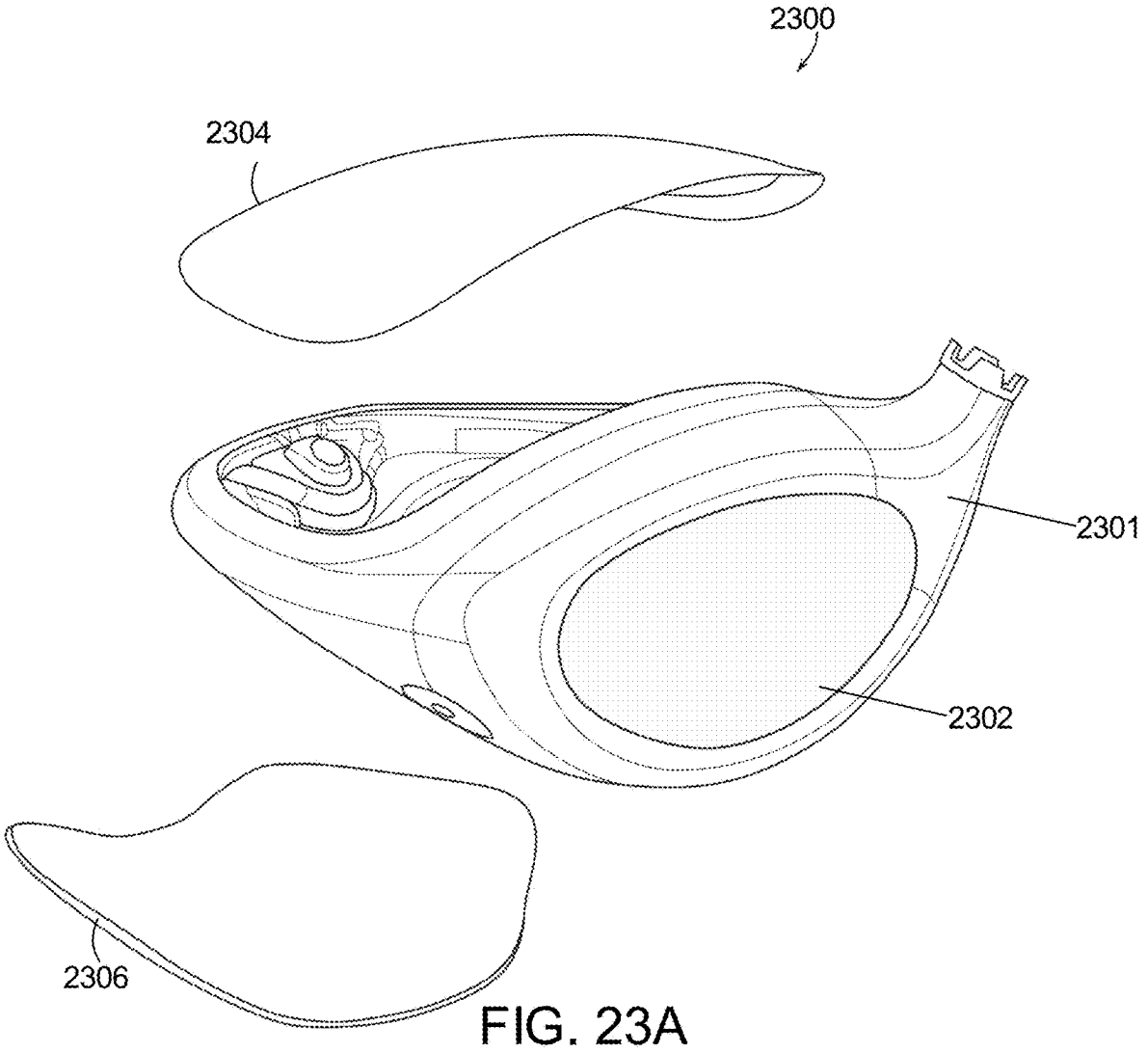
FIG. 23A of the accompanying drawings shows an exploded perspective of a golf club head in accordance with an embodiment of the present invention.

FIG. 23A of the accompanying drawings shows an exploded perspective of a golf club head 2300 in accordance with an embodiment of the present invention. Golf club head 2300 may be similar to golf club head 400 discussed above and depicted in FIG. 4. For example, golf club head 2300 includes a crown 2304 and a sole 2306 that are detachable from the chassis 2301. The golf club head also includes a striking face 2302. The crown 2304 and/or the sole 2306 may be formed from a "sandwich-type" structure and include multiple layers to allow for the crown 2304 and/or the sole 2306 to have high stiffness and durability characteristics, while still maintaining a low mass.

Figure 23B:
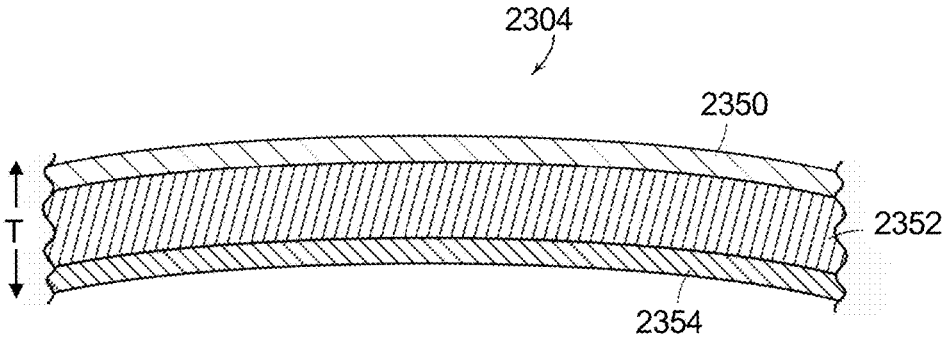
FIG. 23B of the accompanying drawings shows an enlarged cross-sectional view of a portion of a crown of the golf club head depicted in FIG. 23A in accordance with an embodiment of the present invention.

FIG. 23B of the accompanying drawings shows an enlarged cross-sectional view of a portion of a crown 2304 of the golf club head 2300 depicted in FIG. 23A in accordance with an embodiment of the present invention. The sandwich-type structure that makes up the crown can be more clearly seen in FIG. 23B. The sandwich-type structure of the crown 2304 includes an outer layer 2350, a middle layer 2352, and an inner layer 2354. The exterior surface of the outer layer faces the exterior of the crown 2304 and the golf club head 2300. The middle layer 2352 is in contact with the outer layer 2350 and the inner layer 2354. The interior surface of the inner layer 2354 faces the interior or cavity of the golf club head 2300. The total thickness (T) of the crown is the sum of the thicknesses of each of the layers, and the thickness (T) may be measured from the interior surface of the inner layer to the exterior surface of the outer layer. For instance, the total thickness (T) of the crown is generally equal to sum of the thickness of the outer layer 2350, the thickness of the middle layer 2352, and the thickness of the inner layer 2354. As will discussed further below, the total thickness (T) of the crown 2304 is generally thicker than what was previously pursued by those having skill in the art. To reduce mass, the generally accepted view was to reduce the thickness of the crown 2304. The present inventors, however, have gone against that traditional wisdom to create a thicker crown that still has low mass properties while maintaining high stiffness and durability. For instance, in examples of the present technology, the crown 2304 may have an areal density of less than 1000 grams per square meter (g/m$^2$) yet have a thickness (T) that is greater than or equal to 0.8 mm. In some examples, the thickness (T) of the crown 2304 may be at least 2.5 mm and the areal density may be less than 900 g/m$^2$. In golf club heads where the thickness (T) of the crown varies, the maximum or average thickness may be used. In the above examples, the maximum thickness of the crown 2304 may be 2.5 mm.

To achieve such results for the crown 2304, the layers making up the crown 2304 may be manufactured to have particular specifications. In examples, the middle layer 2352 is the thickest of the three layers. For example, the inner layer 2354 may have a thickness of less than about 0.2 mm and the middle layer 2352 may have a thickness of at least 0.6 mm. The outer layer 2350 may have a thickness that is about the same as the thickness of the inner layer 2354. The areal densities of each of the layers also have an effect on the total areal density for the crown 2304. As an example, the outer layer 2350 may have an areal density of less than about 400 g/m$^2$. The middle layer 2352 may have an areal density of less than about 300 g/m$^2$. The inner layer 2354 may have an areal density of less than about 200 g/m$^2$. In some examples, the inner layer 2354 and the outer layer 2350 may be made from a carbon-fiber material, a thermoplastic composite material, a thermoset material, a solid or foamed polymer, a metal, or a super wood. The middle layer 2352 may be made from a foamed material, such as a foamed polymer, graphite, or aluminum. The middle layer 2352 may also include balsa wood, graphitic foams, liquid crystalline polymer foams, or microcellular carbon.

By using such a sandwich-type structure for at least a portion of the crown 2304, high stiffness-to-mass ratios can be achieved. Through the selection of the different layers, additional acoustic and stiffness customizations are also provided. For instance, different geometries and types of materials may be used to target different sounds or frequencies that are emitted from the golf club head when the golf club head strikes a golf ball. Similarly, because different materials can be utilized, additional shaping options are also provided. As an example, the present technology allows for crowns to take on many different shapes without being limited by curvature to achieve various levels of desired stiffness. Such shaping flexibility may yield volume savings or aerodynamic improvements. While a crown has been generally discussed herein, the materials, properties, and measurements may be equally used for a sole of the golf club head. Such sandwich-type structures may also be used for the skirt, internal structures, track or flat weight structures, and elongated or aerodynamic ferrules.

The crown and/or sole may be made from a variety of different manufacturing techniques. The inner, middle, and outer layers may be formed concurrently or separately and then subsequently attached. In one example, pre-fabricated sandwich structures are thermo-formed. In such an example, a thermo-formable sandwich construction method may be performed to create panels of the sandwich structure. Construction may include generating a foamed core between an inner and outer carbon-fiber skin. The foamed core may be a thermoplastic foam material that matches and/or is thermally compatible with the matric material in the composite inner and outer layers. The constructed panels may then be heated via infrared or other techniques. The panels may then be formed in a mold to the desired shape for the crown and/or the sole, potentially including variable thickness as well. For example, a FITS (Foamed In-situ Thermoform Sandwich) system panel may be utilized, such as a panel from FITS Technology of Driebergen, The Netherlands. Such panels may be based on a polyetherimide (PEI) thermoplastic polymer system for the matrix and/or foam material. The inner layer and outer layer in such panels may be a thermoplastic composite skin, such as the TenCate Cetex® thermoplastic composites available from Toray Advanced Composites of Morgan Hill, Calif. Such constructions may result in crowns having a maximum thickness of 3.2 mm or greater and areal densities (g/m$^2$) that are equal to, or less than, simpler composite constructions having thickness of 0.6 mm. As another example, a thermoplastic honeycomb panel may also be utilized, such as the honeycomb panels from EconCore of Leuven, Belgium. In such an example, a honeycomb middle layer may be utilized, such as a ThermHex® honeycomb core from ThermHex Waben GmbH, of Halle (Saale), Germany. The outer layer and the inner layer may be made from materials such as Tepex® materials available from Bond-Laminates GmbH of Brilon, Germany. Other thermoformable sandwich constructions are also available, such as sandwich construction made from materials from Topkey Corporation of Taiwan.

In another example, custom foam sandwich structures may be directly constructed. For example, a foamed polymer core may be created from heating a gas-saturated polymer sheet in a process published by Martini et al. That process is described in M. Itoh and A. Kabumoto, Effects of Crystallization on Cell Morphology in Microcellular Polyphenylene Sulfide, *Furukawa Rev.,* 2005, vol. 28, 32-38, which is incorporated by reference herein in its entirety. In summary, the process includes saturating, in a pressure chamber, a thin polymer sheet with carbon dioxide or nitrogen gas under high pressure at room temperature for a determined period of time. If the pressure is higher, a shorter time is needed to achieve saturation. The gas pressure in the pressure chamber is then rapidly reduced and the polymer sheet is heated above its glass transition temperature to initiate foaming. Different temperatures may be used depending on the desired foam properties. The foaming process may be done before or after joining the polymer sheet to other thermoplastic composite skins as the inner layer and the outer layer. Such joining may be achieved via ultrasonic welding.

A ribbed sandwich construction may also be utilized to create the sandwich-type structure of the crown. The ribbed structure may be used to further stiffen the sandwich-type structure. The ribbed sandwich structure may also utilize a honeycomb or hex-pattern core, such as the ThermHex® honeycomb core discussed above. The honeycomb structure may use an engineered thermoplastic polymer, such as a polyphenylene sulfide (PPS), a polyether ether ketone (PEEK), a polyamide (PA), or similar polymer. The honeycomb hex pattern making up the middle layer may have a height or thickness of 0.5 mm to more than 3 mm. The honeycomb middle layer may be joined to the inner surface of the outer layer via injection molding. In an example, the injection molding process includes first heating the outer layer in the mold, and then the injection molding of the honeycomb middle layer happens afterward. Such a hybrid molding process is available from Bond-Laminates. The inner layer and outer layer may be a thermoset material, but they may also include thermoplastic matrix material. In some examples, the inner layer may also have cutouts to save mass, as discussed in further detail below with reference to FIGS. 26A-B. The inner layer may be joined to the outer layer and the middle layer via ultrasonic welding. In other examples, the inner layer may be omitted entirely where no additional stiffness provided by the inner layer is required or desired.

In another example, an injection molded foam may be used in manufacturing a sandwich structure. For instance, a foaming agent may be incorporated into the molten polymer of an injection molding process. The foaming of the polymer and the generation of the skins (e.g., the inner layer and the outer layer) may be produced as part of the molding process. Such an injection molding process may include a hybrid molding process as discussed above where the thermoforming of the outer layer and the injection molding of the middle layer happens in the same mold. The foamed polymer middle layer may also be formed from the MuCell® injection molding process. Core back features may be utilized in some examples to further lower polymer density.

Figure 24A:
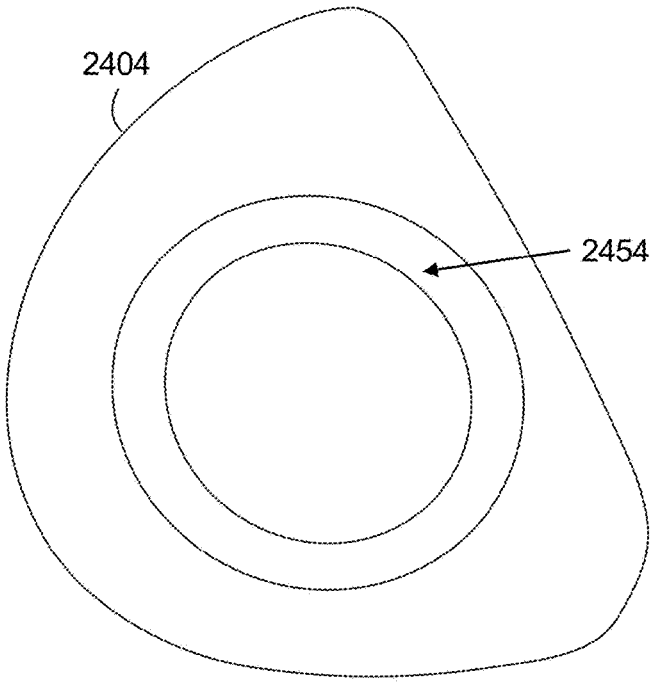
FIG. 24A of the accompanying drawings shows a bottom view of a crown of a club head in accordance with an embodiment of the present invention.
Figure 24B:
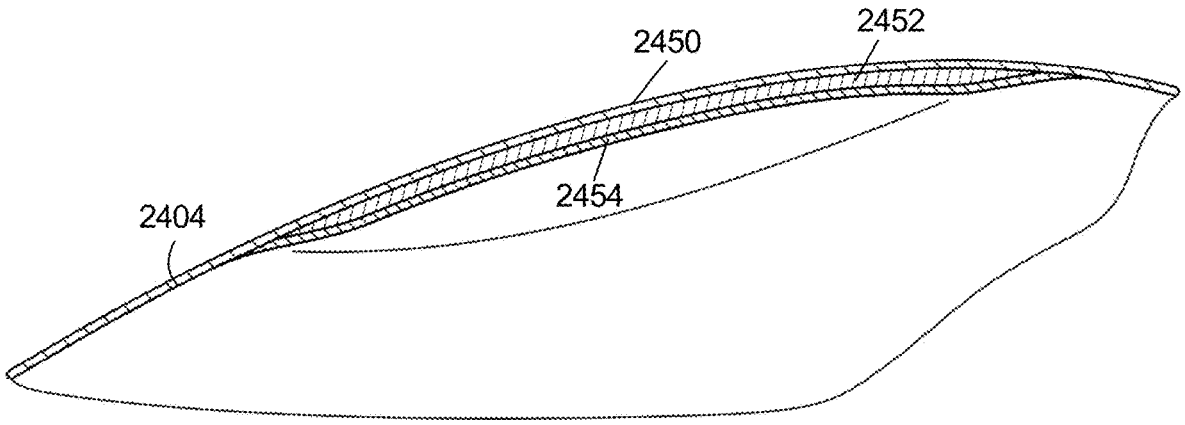
FIG. 24B of the accompanying drawings shows a cross-sectional side view of the crown depicted in FIG. 24A in accordance with an embodiment of the present invention.

FIG. 24A of the accompanying drawings shows a bottom view of a crown 2404 of a club head in accordance with an embodiment of the present invention. FIG. 24B of the accompanying drawings shows a cross-sectional side view of the crown depicted in FIG. 24A in accordance with an embodiment of the present invention. FIGS. 24A-24B are discussed concurrently. In the example crown 2404, a circular section of the crown 2404 is made from a sandwich-type structure. In the circular section, the sandwich-type structure includes an outer layer 2450, a middle layer 2452, and an inner layer 2454. The portion of the crown 2404 that is made from the sandwich-type structure may be at least 70% or more of the crown 2404. In some examples, the portion of the crown 2404 made from the sandwich-type structure may be at least 80% or 90% of the crown 2404.

Figure 25A:
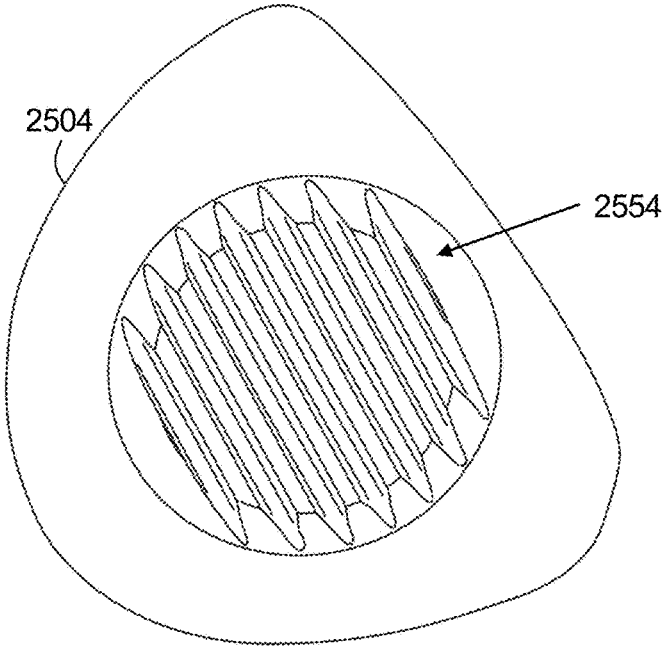
FIG. 25A of the accompanying drawings shows a bottom view of a crown of a club head in accordance with an embodiment of the present invention.
Figure 25B:
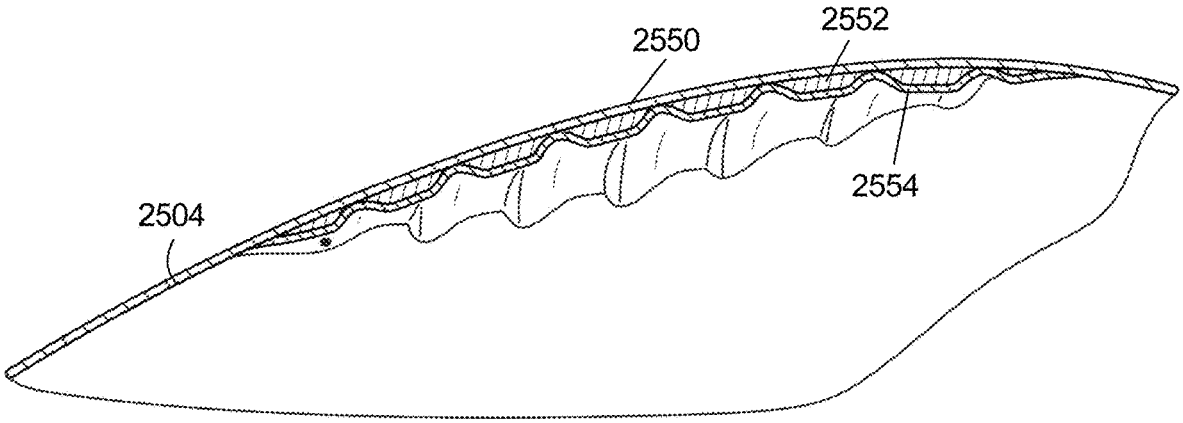
FIG. 25B of the accompanying drawings shows a cross-sectional side view of the crown depicted in FIG. 25A in accordance with an embodiment of the present invention.

FIG. 25A of the accompanying drawings shows a bottom view of a crown of a club head in accordance with an embodiment of the present invention. FIG. 25B of the accompanying drawings shows a cross-sectional side view of the crown depicted in FIG. 25A in accordance with an embodiment of the present invention. FIGS. 25A-25B are discussed concurrently. The example crown 2504, a circular portion of the crown 2504 is made from a sandwich-type structure. The sandwich-type structure of the crown 2504, however, has a ribbed pattern. In the sandwich-type structure, the maximum thickness of the crown 2504 occurs at the peaks of the ribs where the thickness is the sum of the thicknesses of the outer layer 2450, the middle layer 2552, and the inner layer 2454. The minimum thickness of the crown 2504 occurs at the valleys of the ribs where middle layer 2552 is omitted. At such valleys, the thickness of the crown 2504 is the sum of the thicknesses of the outer layer 2550 and the inner layer 2554. In other examples, at such valleys, the middle layer 2552 is minimized, but not omitted. The ribs may be evenly spaced throughout the sandwich-type structure.

Figure 26A:
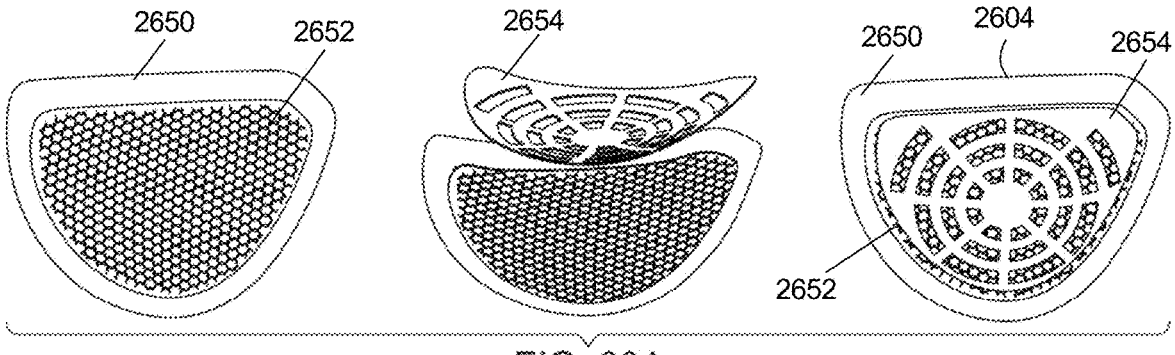
FIG. 26A of the accompanying drawings shows a plurality of layers of a crown in accordance with an embodiment of the present invention.
Figure 26B:
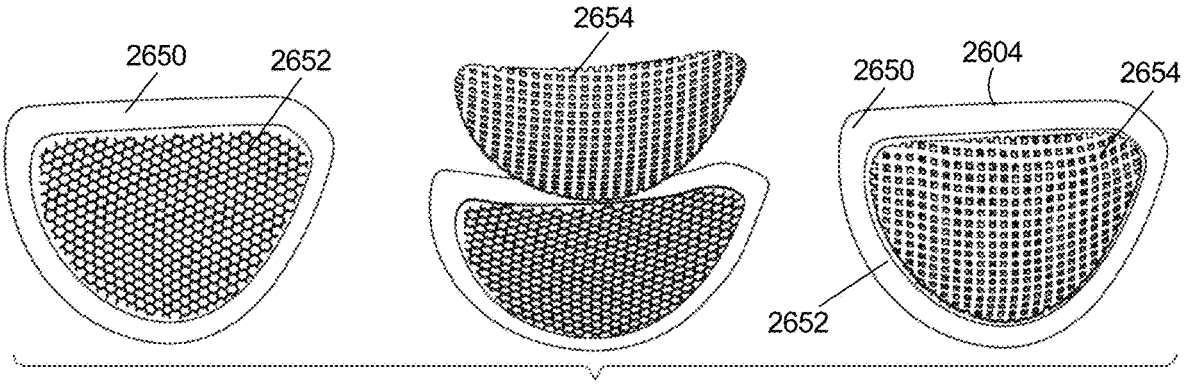
FIG. 26B of the accompanying drawings shows a plurality of layers of a crown in accordance with an embodiment of the present invention.

FIG. 26A of the accompanying drawings shows a plurality of layers of a crown 2604 in accordance with an embodiment of the present invention. In particular, FIG. 26A shows multiple stages of generating the sandwich-type structure for the crown 2604. At the first stage, a first layer 2650 has a middle layer 2652 attached. In the example depicted, the middle layer 2652 is a honeycomb or hex structure. The honeycomb structure of the middle layer 2652 may be any of the honeycomb structures and/or formed from the processes discussed above. At the second stage, the inner layer 2654 is attached to the middle layer 2652 and, in some examples, the first layer 2650. As discussed above, the inner layer 2654 may be attached using a variety of methods, such as ultrasonic welding. The inner layer 2654 has had portions removed to reduce the overall mass of the inner layer 2654. Such an inner layer 2654 with portions removed may be referred to as a partial inner layer. In the example shown in FIG. 26A, portions of inner layer 2654 have been removed in a radial pattern. At the third stage, the final assembled sandwich structure of the crown 2604 is shown. FIG. 26B of the accompanying drawings shows a plurality of layers of a crown 2604 in accordance with an embodiment of the present invention. FIG. 26B is substantially the same as FIG. 26A with the exception of the inner layer 2654. The inner layer 2654 in FIG. 26B is also a partial inner layer, but portions have been removed in a checkerboard pattern rather than a radial pattern.

Figure 27:
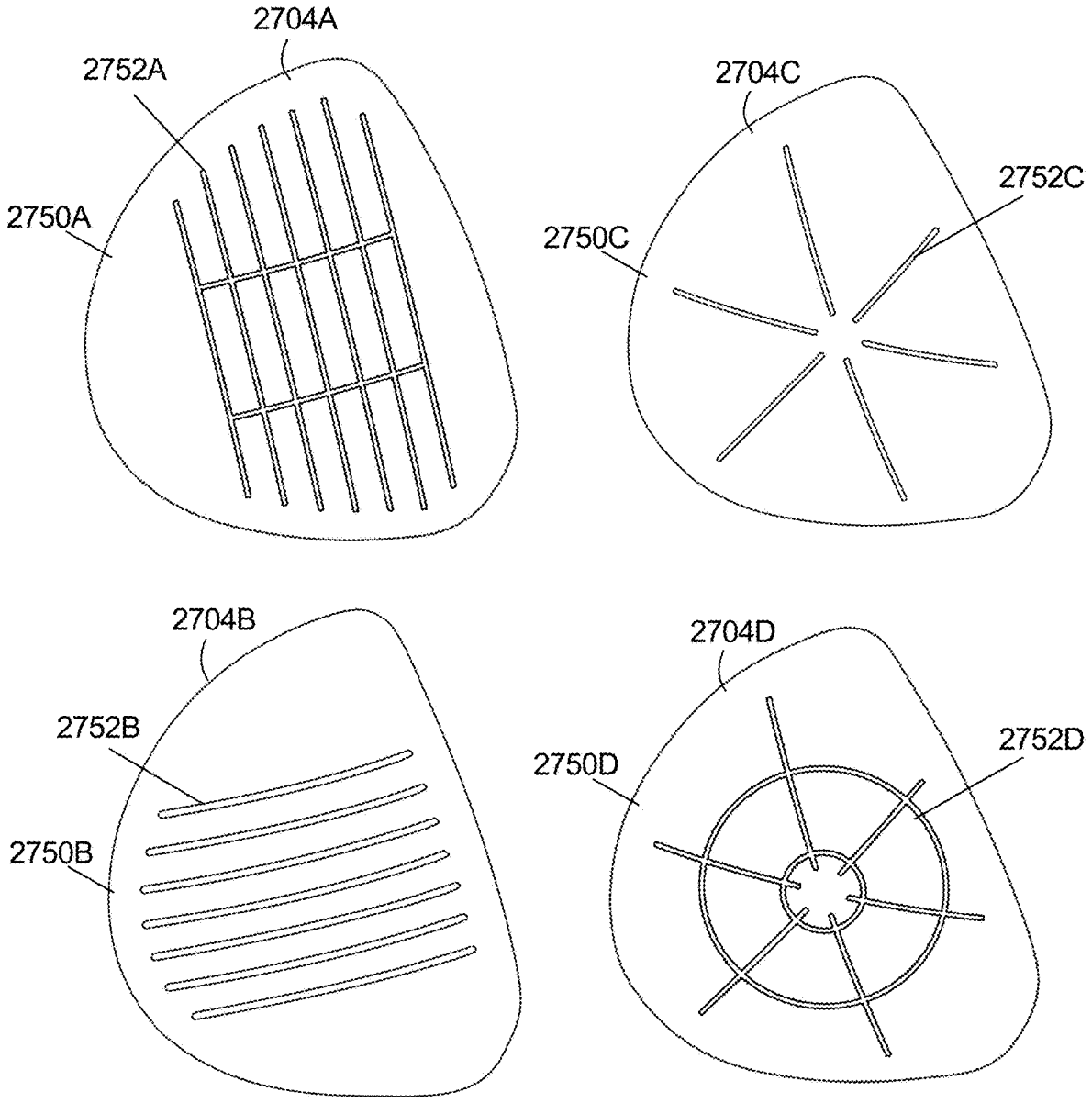
FIG. 27 of the accompanying drawings shows a plurality of configurations of a crown in accordance with an embodiment of the present invention.

FIG. 27 of the accompanying drawings shows a bottom views of a plurality of configurations of a crown in accordance with an embodiment of the present invention. More specifically, four different configurations of middle layers of the sandwich structure are shown in FIG. 27. Instead of a honeycomb structure, the middle layer may be formed as the structures depicted in FIG. 27, among other structures. For example, a first crown 2704A has a middle layer 2752A formed on an outer layer 2750A. The middle layer 25752A is formed as a grate or a series of intersecting ribs that protrude from the outer layer 2750A towards the interior of the golf club head. As another example, a second crown 2704B has a middle layer 2752B formed on an outer layer 2750B. The middle layer 2752B is formed as a series of parallel ribs that protrude from the outer layer 2750B towards the interior of the golf club head. As another example, a third crown 2704C has a middle layer 2752C formed on an outer layer 2750C. The middle layer 2752C is formed as a plurality of protruding ribs extending radially away from the center of the outer layer 2750C. As another example, a fourth crown 2704D has a middle layer 2752D formed on an outer layer 2750D. The middle layer 2752D is formed as plurality of protruding ribs extending radially away from the center of the outer layer 2750D as well as a plurality of protruding ribs in the form of concentric circles that intersect with radially extending ribs.

FIG. 28 of the accompanying drawings shows a table of data representing characteristics of example crowns in accordance with embodiments of the present invention. More specifically, the table in FIG. 28 provides data for five different crowns: a crown made from titanium only, a crown made from a composite only, and three example crowns according to the present technology. The density (ρ), thickness (t), areal density (AW), area (A), and mass for each layer and for the total crown are provided for each crown in the table. The crowns had the same general shape as the example crowns discussed above. The titanium and composite crowns are provided for a baseline against the present examples. As can be seen from the table, the titanium crown has a density of 4.45 g/cm$^3$, a thickness of 0.4 mm, an areal density of 960 g/m$^2$ an area of 9000 mm$^2$, and a mass of 16 g. Because there is only one layer for the titanium crown, those values are also the total values. The composite crown has a density of 1.6 g/cm$^3$, a thickness of 0.6 mm, an areal density of 960 (g/m$^2$) an area of 9000 mm$^2$, and a mass of 8.6 g. Because there is only one layer for the composite crown, those values are also the total values for the crown.

The first example golf club (Example 1) had a crown with three layers. The outer layer was a PEI laminate skin that had a density of 1.91 g/cm$^3$, a thickness of 0.2 mm, an areal density of 382 g/m$^2$, an area of 9000 mm$^2$, and a mass of 3.4 g. The middle layer was an in-situ PEI foam that had a density of 0.1 g/cm$^3$, a thickness of 2.9 mm, an areal density of 290 g/m$^2$, an area of 9000 mm$^2$, and a mass of 2.6 g. The inner layer was a PEI laminate skin that had a density of 1.91 g/cm$^3$, a thickness of 0.1 mm, an areal density of 191 g/m$^2$, an area of 9000 mm$^2$, and a mass of 1.7 g. Accordingly, the crown of Example 1 had a total area of 9000 mm$^2$, a total mass of 7.767 g, a total thickness of 3.2 mm and a total areal density of 863 g/m$^2$.

The second example golf club (Example 2) also had a crown with three layers. The outer layer was a PPS skin that had a density of 1.6 g/cm$^3$, a thickness of 0.25 mm, an areal density of 400 g/m$^2$, an area of 9000 mm$^2$, and a mass of 3.6 g. The middle layer was a PPS honeycomb that had a density of 1.0 g/cm$^3$, a thickness of 1.5 mm, an areal density of 240 g/m$^2$, an area of 9000 mm$^2$, and a mass of 2.2 g. The inner layer was a partial layer that was a PPS skin that had a density of 1.6 g/cm$^3$, a thickness of 0.25 mm, an areal density of 200 g/m$^2$, an area of 9000 mm$^2$, and a mass of 1.8 g. Thus, the crown of Example 2 had a total area of 9000 mm$^2$, a total mass of 7.56 g, a thickness total of 2 mm, and a total areal density of 840 g/m$^2$.

The third example golf club (Example 3) also had a crown with three layers. The outer layer was a PPS skin that had a density of 1.6 g/cm$^3$, a thickness of 0.25 mm, an areal density of 400 g/m$^2$, an area of 9000 mm$^2$, and a mass of 3.6 g. The middle layer was a PPS foam that had a density of 0.35 g/cm$^3$, a thickness of 1 mm, an areal density of 350 g/m$^2$, an area of 9000 mm$^2$, and a mass of 3.2 g. The inner layer was a partial layer that was a PPS skin that had a density of 1.6 g/cm$^3$, a thickness of 0.25 mm, an areal density of 200 g/m$^2$, an area of 9000 mm$^2$, and a mass of 1.8 g. Thus, the crown of Example 3 had a total area of 9000 mm$^2$, a total mass of 8.55 g, a total thickness of 1.5 mm, and a total areal density of 950 g/m$^2$.

As can be seen, the examples of the present technology are able to achieve lower areal densities despite having greater thicknesses. As the examples of the present technology may be formed or molded into a substantial number of different shapes that still preserve the stiffness and durability of the crown, the examples provide for an improved golf club having a lower total mass. The reduction in mass allows for higher swing speeds by a golfer and/or the ability to place discretionary weights in other areas of the golf club head. In addition, the different layers from the respective examples in the table may be combined with layers of other examples to form additional examples.

FIG. 29 of the accompanying drawings shows a table representing characteristics of example crowns in accordance with embodiments of the present invention. The crowns had the same general shape as the example crowns discussed above. For each example crown, the mass and a deflection are provided. The deflection is the amount the crown deflects when a 20 MPa pressure is applied to the substantially geometric center of the crown. The pressure is applied downward on the crown or in direction towards the sole or bottom of the golf club head if the crown is attached to the golf club head. An amount of increase in mass versus the baseline crown and an amount of change in deflection is also shown in the table. In general, a decrease in mass (indicated by a negative percentage) is desired with a decrease in deflection (indicated by a percentage less than 100%). The deflection score, or D Score, is a measure that accounts for such a change in mass as well as a change in deflection properties. The D Score is equal to 100% minus the mass increase vs baseline value plus 100% minus the deflection vs baseline value. The D Score, however, is represented in a decimal form rather than a percentage form (e.g., 0.31 rather than 31%). A representative equation for the D Score is thus:

$$DS=(100\%-\Delta M)+(100\%-\Delta D)$$

where DS is the D Score, ΔM is the percentage change from the baseline mass of 5.21, and ΔD is the percentage change from the baseline deflection of 3.96. A D score of greater than 1 is indicative of an improved more efficient crown in that it has combined change in mass and change in deflection that is better than the baseline. Higher D Scores indicate higher efficiencies of the crown. Accordingly, in some examples, golf clubs having a D score of at least 1.3, 1.4, 1.5, or even 1.6 are utilized to more fully take advantage of the improvements of the present technology.

The baseline crown is a composite crown having a 0.5 mm thickness. The Example 1 crown is a titanium crown having a 0.4 mm thickness. The Example 2 crown is a crown having a polycarbonate foam middle layer, a 0.25 mm-thick outer layer, and no inner layer. The Example 3 crown is a crown having a polycarbonate foam middle layer with composite outer and inner layers each having a 0.25 mm thickness. The difference in deflection values from Examples 2 and 3 demonstrate the additional stiffness of the crown that results from adding an inner layer. The Example 4 crown is a crown that has a polycarbonate honeycomb middle layer with no outer layer or inner layer. The Example 4 crown shows how high deflection results from a lack of either an outer layer or an inner layer. The Example 5 crown is a crown having a honeycomb middle layer with an outer layer having a 0.25 mm thickness. The Example 6 crown is a honeycomb middle layer, but with larger hex patterns than Example 5, with an outer layer having a 0.25 mm thickness. The Example 7 crown is a crown with a honeycomb middle layer with composite outer and inner layers each having a 0.125 mm thickness. The Example 8 crown is a crown with a honeycomb middle layer with composite outer and inner layers each having a 0.25 mm thickness. The Example 9 crown is a crown that has a honeycomb middle layer with a composite outer layer with a 0.25 mm thickness and an inner layer in the shape of a circle having an area of about 50% of the area of the middle layer. The Example 10 crown is a crown that has a honeycomb middle layer with a composite outer layer with a 0.25 mm thickness and an inner layer in the shape of a plus sign centered on the middle layer. The Example 11 crown is a crown that has a honeycomb middle layer with a composite outer layer with a 0.25 mm thickness and an inner layer in the shape of a ring centered on the middle layer.

Figure 30:
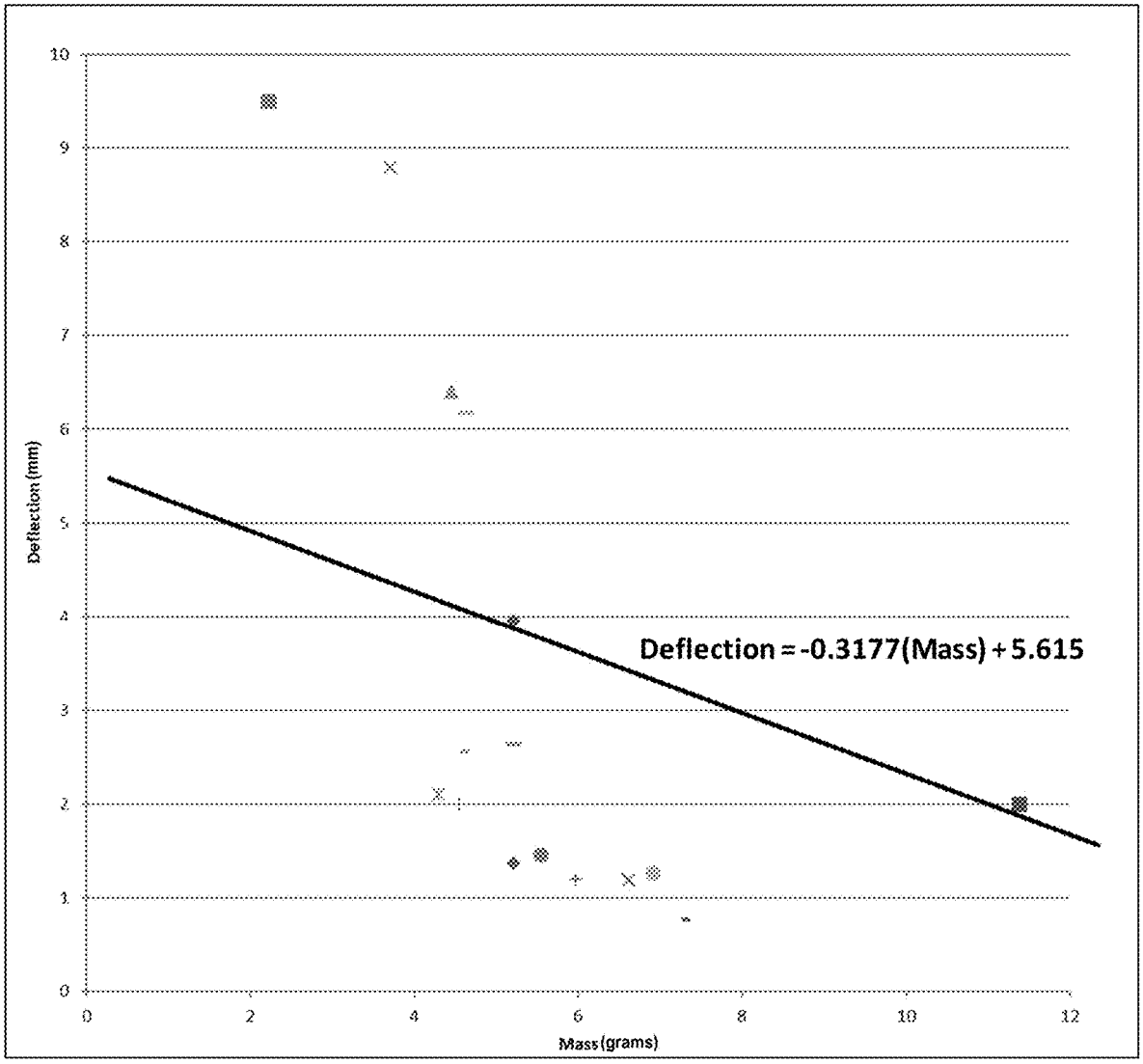
FIG. 30 of the accompanying drawings shows a plot of data for deflection versus mass of example crowns in accordance with embodiments of the present invention.

FIG. 30 of the accompanying drawings shows a plot of data for deflection versus mass of example crowns in accordance with embodiments of the present invention. More specifically, the plot includes a plurality of data points for example golf clubs in the table shown in FIG. 29 with several additional data points. An efficiency line is displayed on the plot. The efficiency line is represented by the following equation:

$$\text{Deflection}=-0.3177(\text{Mass})+5.615$$

where deflection is the deflection in millimeters of the crown when a 20 MPa pressure is applied to the geometric center of the crown and the mass is the mass of the crown in grams. It has been found the crowns having mass and deflection properties below the efficiency line provide a combined improved mass and deflection properties, thus providing for a lighter, more durable golf club head. Accordingly, improved crowns have been identified where an amount of deflection of the crown as a function of a mass of the crown is governed by the following equation when subjected to a pressure of 20 MPa: $\text{Deflection}\leq-0.3177\ (\text{Mass})+5.615$. Again while the above properties and data have been discussed for crowns, similar properties may also apply to other regions of a golf club head, such as the sole or weight support areas.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:
a striking face;
a sole; and
a crown, the crown having an areal density of less than 1000 g/m$^2$ and made from a structure comprising:
an inner layer having an areal density of less than about 200 g/m$^2$;
a middle layer in contact with the inner layer, the middle layer having a thickness of at least 0.6 mm; and
an outer layer in contact with the middle layer, wherein a distance between an interior surface of the inner layer and an exterior surface of the outer layer is at least 0.8 mm;
wherein an amount of deflection of the crown as a function of a mass of the crown is governed by the following equation when subjected to a downward force of 20 MPa at a geometric center of the crown: $\text{Deflection}\leq-0.3177\ (\text{Mass})+5.615$, and the crown has a D Score of at least 1.3.

2. The golf club head of claim 1, wherein the distance between the interior surface of the inner layer and the exterior surface of the outer layer is at least 3.0 mm.

3. The golf club head of claim 1, wherein:
the inner layer has a thickness of less than about 0.2 mm.

4. The golf club head of claim 1, wherein the crown has an areal density of less than 900 g/m$^2$.

5. The golf club head of claim 1, wherein:
the outer layer has an areal density of less than about 400 g/m$^2$; and
the middle layer has an areal density of less than about 300 g/m$^2$.

6. The golf club head of claim 1, wherein:
the inner layer and the outer layer comprise a carbon-fiber material; and
the middle layer comprises a foamed material.

7. The golf club head of claim 1, wherein the inner layer and the outer layer comprise a thermoplastic composite material.

8. A golf club head comprising:
a striking face;
a sole; and
a crown, the crown having an areal density of less than 1000 g/m$^2$ and made from a structure comprising:
an inner layer having a first areal density;
a middle layer in contact with the inner layer, the middle layer having a second areal density greater than the first areal density; and
an outer layer in contact with the middle layer, the outer layer having a third areal density greater than the second areal density,
wherein an amount of deflection of the crown as a function of a mass of the crown is governed by the following equation when subjected to a downward force of 20 MPa at a geometric center of the crown: Deflection≤−0.3177 (Mass)+5.615.

9. The golf club head of claim 8, wherein a distance between an interior surface of the inner layer and an exterior surface of the outer layer is at least 0.8 mm.

10. The golf club head of claim 8, wherein the crown has a D Score of at least 1.6.

11. The golf club head of claim 8, wherein the middle layer comprises a foamed material.

12. The golf club head of claim 8, wherein the inner layer is a partial layer with a plurality of cutouts.

13. The golf club head of claim 8, wherein the structure comprises at least 80 percent of the crown.

14. The golf club head of claim 8, wherein the middle layer is a honeycomb structure.

15. The golf club head of claim 8, wherein the middle layer is formed as a series of intersecting ribs that protrude from the outer layer.

16. The golf club head of claim 8, wherein the middle layer is formed as a series of protruding ribs extending radially away from a center of the outer layer.

17. A golf club head comprising:

a striking face;

a sole; and a crown, the crown having an areal density of less than 900 g/m$^2$ and including a portion made from a structure comprising:

a partial inner layer including a plurality of cutouts and having a thickness of less than or equal to about 0.25 mm;

a middle layer in contact with the partial inner layer, the middle layer having a thickness of at least 1.5 mm; and an outer layer in contact with the middle layer, wherein a distance between an interior surface of the partial inner layer and an exterior surface of the outer layer is at least 2 mm, wherein the crown has a D Score of at least 1.3 when the crown is deflected in response to a downward force of 20 MPa at a geometric center of the crown.

18. The golf club head of claim 17, wherein the cutouts form one of a checkerboard pattern or a radial pattern.

19. The golf club head of claim 17, wherein the outer layer has a thickness that is substantially the same as the thickness of the partial inner layer.

20. The golf club head of claim 17, wherein the middle layer has a density between 0.10 and 1.0 grams per cubic centimeter.

21. The golf club head of claim 17, wherein the portion makes up at least 80% of the crown.

22. The golf club head of claim 17, wherein the partial inner layer is joined to the middle layer via ultrasonic welding.

* * * * *